US012134009B1

(12) United States Patent
Joseph

(10) Patent No.: US 12,134,009 B1
(45) Date of Patent: Nov. 5, 2024

(54) BASKETBALL LAUNCHING DEVICE USING MACHINE VISION

(71) Applicant: Shoot-A-Way, Inc., Upper Sandusky, OH (US)

(72) Inventor: John G. Joseph, Upper Sandusky, OH (US)

(73) Assignee: Shoot-A-Way, Inc., Upper Sandusky, OH (US)

( * ) Notice: Subject to any disclaimer, the term of this patent is extended or adjusted under 35 U.S.C. 154(b) by 222 days.

(21) Appl. No.: 17/961,259

(22) Filed: Oct. 6, 2022

Related U.S. Application Data

(63) Continuation-in-part of application No. 17/160,929, filed on Jan. 28, 2021, now Pat. No. 11,577,146,
(Continued)

(51) Int. Cl.
*A63B 24/00* (2006.01)
*A63B 69/00* (2006.01)
(Continued)

(52) U.S. Cl.
CPC ..... *A63B 24/0062* (2013.01); *A63B 69/0071* (2013.01); *A63B 69/40* (2013.01);
(Continued)

(58) Field of Classification Search
CPC . A63B 24/0062; A63B 69/0071; A63B 69/40; A63B 71/0605; A63B 71/0622; A63B 71/0669; A63B 2024/0037; A63B 2071/0675; A63B 2210/50; A63B 2220/05; A63B 2220/807; A63B 2225/093; A63B 2225/50
See application file for complete search history.

(56) References Cited

U.S. PATENT DOCUMENTS 435,964 A 9/1890 Compton
1,223,386 A 4/1917 Handelan
(Continued)

FOREIGN PATENT DOCUMENTS

CN 303127130 3/2015
CN 303207615 5/2015
(Continued)

*Primary Examiner* — Jeffrey S Vanderveen
(74) *Attorney, Agent, or Firm* — Standley Law Group LLP; Jeffrey S. Standley; Adam J. Smith

(57) ABSTRACT

A system for automatically detecting made and missed basketball shots using machine vision includes a launcher connected to a structural subassembly which passes basketballs to locations about a basketball playing area. One or more cameras are connected to the structural subassembly and capture images of an underside or an upper side of a rim of the basketball goal. One or more controllers program the launcher to pass the basketballs to select locations forming part of a basketball practice arrangement, receive images from the camera(s), associate each of the received images with one of the passes from the launcher forming part of the basketball practice arrangement, and process each of the received images using a machine vision model to determine which of said received images indicate a made shot.

20 Claims, 23 Drawing Sheets

Related U.S. Application Data which is a continuation-in-part of application No. 16/894,005, filed on Jun. 5, 2020, now Pat. No. 11,400,355.

(60) Provisional application No. 62/858,524, filed on Jun. 7, 2019.

(51) Int. Cl.
*A63B 69/40* (2006.01)
*A63B 71/06* (2006.01)

(52) U.S. Cl.
CPC ..... *A63B 71/0605* (2013.01); *A63B 71/0622* (2013.01); *A63B 71/0669* (2013.01); *A63B 2024/0037* (2013.01); *A63B 2071/0675* (2013.01); *A63B 2210/50* (2013.01); *A63B 2220/05* (2013.01); *A63B 2220/807* (2013.01); *A63B 2225/093* (2013.01); *A63B 2225/50* (2013.01)

(56) References Cited

U.S. PATENT DOCUMENTS

D174,027 S 2/1955 Farkas
2,908,266 A 10/1959 Cooper
D204,309 S 4/1966 Murray
3,776,550 A 12/1973 McNabb
3,802,703 A 4/1974 Van Tassel
3,878,828 A 4/1975 Francesco
4,168,695 A 9/1979 Haller et al.
4,262,648 A 4/1981 Wegener et al.
4,269,163 A 5/1981 Feith
4,471,746 A 9/1984 Ando
4,579,340 A 4/1986 Jenkins et al.
D287,854 S 1/1987 Crews
4,667,957 A 5/1987 Joseph
4,678,189 A 7/1987 Koss
4,714,248 A 12/1987 Koss
4,717,149 A 1/1988 Juhl
4,913,431 A 4/1990 Jakobs
4,936,577 A 6/1990 Kington et al.
4,940,231 A 7/1990 Ehler
4,955,605 A 9/1990 Goldfarb
5,016,875 A 5/1991 Joseph
5,039,977 A 8/1991 Mele et al.
5,125,651 A 6/1992 Keeling et al.
5,312,099 A 5/1994 Oliver, Sr.
5,342,041 A 8/1994 Aguinek et al.
5,365,427 A 11/1994 Soignet et al.
5,393,049 A 2/1995 Nelson
5,409,211 A 4/1995 Adamek
5,417,196 A 5/1995 Morrison et al.
5,418,517 A 5/1995 Matherne et al.
5,450,540 A 9/1995 Spohrer et al.
5,540,428 A 7/1996 Joseph
5,647,747 A 7/1997 Macri et al.
5,676,120 A 10/1997 Joseph
5,681,230 A 10/1997 Krings
5,746,668 A 5/1998 Ochs
5,768,151 A 6/1998 Lowy et al.
5,776,018 A 7/1998 Simpson et al.
5,807,195 A 9/1998 Westbrook
5,813,926 A 9/1998 Vance
5,816,953 A 10/1998 Cleveland
5,842,699 A 12/1998 Mirando et al.
6,224,503 B1 5/2001 Joseph
6,241,628 B1 6/2001 Jenkins
D445,426 S 7/2001 Wang et al.
6,389,368 B1 5/2002 Hampton
6,659,893 B1 12/2003 Campbell et al.
6,707,487 B1 3/2004 Aman et al.
6,731,316 B2 5/2004 Herigstad et al.
6,746,397 B2 6/2004 Lee et al.
6,918,591 B2 7/2005 D'Amico et al.
7,094,164 B2 8/2006 Marty et al.
D554,661 S 11/2007 Hoover et al.
D554,662 S 11/2007 Hoover et al.
D591,305 S 4/2009 Shimoda
7,620,466 B2 11/2009 Neale et al.
7,850,552 B2 12/2010 Marty et al.
7,854,669 B2 12/2010 Marty et al.
7,927,237 B2 4/2011 Jenkins et al.
D637,199 S 5/2011 Brinda et al.
7,938,746 B2 5/2011 Chipperfield
8,012,046 B2 9/2011 Campbell et al.
8,016,687 B2 9/2011 Martin et al.
8,123,634 B1 2/2012 Lovett
8,147,356 B2 4/2012 Campbell et al.
8,206,246 B2 6/2012 Joseph et al.
8,408,982 B2 4/2013 Marty et al.
8,409,024 B2 4/2013 Marty et al.
D681,662 S 5/2013 Fletcher et al.
D687,845 S 8/2013 Lee
8,540,560 B2 9/2013 Crowley et al.
D690,728 S 10/2013 Brinda
8,579,632 B2 11/2013 Crowley
8,617,008 B2 12/2013 Marty et al.
8,622,832 B2 1/2014 Marty et al.
D704,734 S 5/2014 Wafapoor
8,727,784 B1 5/2014 Wolf
D714,321 S 9/2014 Pereira
D714,325 S 9/2014 Pereira
8,852,030 B2 10/2014 Campbell et al.
8,854,457 B2 10/2014 De Vleeschouwer et al.
8,908,922 B2 12/2014 Marty et al.
8,948,457 B2 2/2015 Marty et al.
9,010,309 B2 4/2015 Lewis et al.
9,015,627 B2 4/2015 Lai
9,017,188 B2 4/2015 Joseph et al.
D737,278 S 8/2015 Shin et al.
D739,488 S 9/2015 Campbell et al.
D745,533 S 12/2015 Luo
D746,855 S 1/2016 Choi
9,233,292 B2 1/2016 Joseph et al.
9,238,165 B2 1/2016 Marty et al.
9,248,368 B2 2/2016 Stimac
9,254,432 B2 2/2016 Ianni et al.
9,283,431 B2 3/2016 Marty et al.
9,283,432 B2 3/2016 Marty et al.
9,345,929 B2 5/2016 Marty et al.
9,358,455 B2 6/2016 Marty et al.
9,370,704 B2 6/2016 Marty
D760,769 S 7/2016 Ishii et al.
D761,840 S 7/2016 Patterson et al.
9,390,501 B2 7/2016 Marty et al.
D762,709 S 8/2016 Hsieh
D767,596 S 9/2016 Shi
9,452,339 B1 9/2016 Shah et al.
D768,143 S 10/2016 Drozd et al.
D768,148 S 10/2016 Jung et al.
9,474,953 B1 10/2016 Duke
D774,518 S 12/2016 Lv
D776,676 S 1/2017 Shi
D778,314 S 2/2017 Li et al.
D783,659 S 4/2017 Park
D786,269 S 5/2017 Lin et al.
D789,393 S 6/2017 Jaini et al.
D790,585 S 6/2017 Kim et al.
9,687,713 B1 6/2017 Duke
D791,786 S 7/2017 Chauhri et al.
9,694,238 B2 7/2017 Marty et al.
9,697,617 B2 7/2017 Marty et al.
9,724,584 B1 8/2017 Campbell et al.
9,734,405 B2 8/2017 Marty et al.
9,808,696 B2 11/2017 Campbell et al.
D808,976 S 1/2018 Shi
9,886,624 B1 2/2018 Marty et al.
9,914,035 B2 3/2018 Campbell et al.
D817,348 S 5/2018 Ishikawa et al.
D818,488 S 5/2018 Frazier
9,975,026 B2 5/2018 Campbell et al.
10,004,949 B2 6/2018 Brothers et al.
10,010,778 B2 7/2018 Marty et al.

(56) References Cited

U.S. PATENT DOCUMENTS

| | | | |
|---|---|---|---|
| D824,955 | S | 8/2018 | Lee et al. |
| 10,092,793 | B1 | 10/2018 | Marty et al. |
| D838,729 | S | 1/2019 | Guerrieri et al. |
| 10,252,133 | B2 | 4/2019 | Campbell et al. |
| 10,315,090 | B2 | 6/2019 | Campbell et al. |
| 10,343,015 | B2 | 7/2019 | Marty et al. |
| 10,360,685 | B2 | 7/2019 | Marty et al. |
| D861,720 | S | 10/2019 | Koller et al. |
| 10,471,325 | B2 | 11/2019 | Marty et al. |
| 10,489,656 | B2 | 11/2019 | Lee et al. |
| 10,537,780 | B2 | 1/2020 | Joseph et al. |
| 10,561,916 | B1 | 2/2020 | Campbell et al. |
| 10,596,436 | B1 | 3/2020 | Campbell et al. |
| 10,610,757 | B1 | 4/2020 | Marty |
| 10,688,362 | B1 | 6/2020 | Sangalang |
| 10,762,642 | B2 | 9/2020 | Marty et al. |
| 10,994,182 | B1 | 5/2021 | Campbell et al. |
| 11,097,176 | B1 | 8/2021 | Campbell et al. |
| 11,123,605 | B1 | 9/2021 | Marty |
| 11,135,500 | B1 | 10/2021 | Campbell et al. |
| 11,247,109 | B1 | 2/2022 | Campbell et al. |
| 11,380,100 | B2 | 7/2022 | Lee et al. |
| 11,450,106 | B2 | 9/2022 | Marty et al. |
| 11,491,383 | B1 | 11/2022 | Campbell et al. |
| D972,675 | S | 12/2022 | Campbell et al. |
| 11,577,139 | B1 | 2/2023 | Campbell et al. |
| 11,715,214 | B1 | 8/2023 | Marty et al. |
| 11,813,510 | B1 | 11/2023 | Campbell et al. |
| 11,890,521 | B1 | 2/2024 | Campbell et al. |
| 11,896,884 | B2 | 2/2024 | Marty et al. |
| 2002/0010032 | A1 | 1/2002 | Stiteler |
| 2003/0023145 | A1 | 1/2003 | Lee et al. |
| 2005/0143154 | A1 | 6/2005 | Bush |
| 2006/0068945 | A1 | 3/2006 | Murchison, III |
| 2006/0160639 | A1 | 7/2006 | Klein |
| 2006/0236993 | A1 | 10/2006 | Cucjen et al. |
| 2007/0026974 | A1 | 2/2007 | Marty et al. |
| 2007/0026975 | A1 | 2/2007 | Marty et al. |
| 2007/0173355 | A1 | 7/2007 | Klein |
| 2007/0265138 | A1 | 11/2007 | Ashby |
| 2008/0015061 | A1 | 1/2008 | Klein |
| 2008/0200287 | A1 | 8/2008 | Marty et al. |
| 2008/0254866 | A1 | 10/2008 | Young et al. |
| 2008/0261726 | A1 | 10/2008 | Chipperfield |
| 2008/0312010 | A1 | 12/2008 | Marty et al. |
| 2009/0042672 | A1 | 2/2009 | Radice |
| 2009/0045578 | A1 | 2/2009 | Wang |
| 2009/0137347 | A1 | 5/2009 | Jenkins et al. |
| 2010/0259412 | A1 | 10/2010 | Pagonakis |
| 2010/0261557 | A1 | 10/2010 | Joseph et al. |
| 2011/0013087 | A1 | 1/2011 | House et al. |
| 2011/0071818 | A1 | 3/2011 | Jiang |
| 2011/0294585 | A1 | 12/2011 | Penna et al. |
| 2012/0115651 | A1 | 5/2012 | Chipperfield |
| 2013/0095959 | A1 | 4/2013 | Marty et al. |
| 2013/0095961 | A1* | 4/2013 | Marty ..... A63B 24/0084 473/450 |
| 2013/0130845 | A1 | 5/2013 | Marty et al. |
| 2013/0172058 | A1 | 7/2013 | Marty et al. |
| 2014/0092253 | A1 | 4/2014 | Marty et al. |
| 2014/0135956 | A1 | 5/2014 | Thurman et al. |
| 2014/0195022 | A1 | 7/2014 | Thurman et al. |
| 2014/0200692 | A1 | 7/2014 | Thurman et al. |
| 2014/0222177 | A1 | 8/2014 | Thurman et al. |
| 2014/0283142 | A1 | 9/2014 | Shepherd et al. |
| 2014/0301601 | A1 | 10/2014 | Marty et al. |
| 2015/0028541 | A1 | 1/2015 | Murakami et al. |
| 2015/0131845 | A1 | 5/2015 | Forouhar et al. |
| 2015/0141144 | A1 | 5/2015 | Sprague et al. |
| 2015/0248917 | A1* | 9/2015 | Chang ..... G11B 27/031 386/282 |
| 2015/0258416 | A1 | 9/2015 | Ianni et al. |
| 2015/0265897 | A1 | 9/2015 | Gordon et al. |
| 2015/0290516 | A1 | 10/2015 | Joseph et al. |
| 2016/0082340 | A1 | 3/2016 | Adams |
| 2016/0121193 | A1 | 5/2016 | Marty et al. |
| 2016/0166907 | A1 | 6/2016 | Joseph et al. |
| 2016/0193518 | A1 | 7/2016 | Baxter et al. |
| 2016/0250540 | A1 | 9/2016 | Joseph et al. |
| 2016/0287964 | A1 | 10/2016 | Jones |
| 2016/0310814 | A1 | 10/2016 | Joseph et al. |
| 2016/0325168 | A1 | 11/2016 | Campbell et al. |
| 2016/0354664 | A1 | 12/2016 | De Carlo |
| 2017/0007921 | A1 | 1/2017 | Baba et al. |
| 2017/0136333 | A1 | 5/2017 | Joseph et al. |
| 2017/0157482 | A1 | 6/2017 | DeCarlo |
| 2017/0161561 | A1 | 6/2017 | Marty et al. |
| 2017/0232298 | A1 | 8/2017 | Joseph et al. |
| 2017/0282044 | A1 | 10/2017 | Moore et al. |
| 2017/0340949 | A1 | 11/2017 | Tsai |
| 2018/0056124 | A1 | 3/2018 | Marty et al. |
| 2018/0322337 | A1 | 11/2018 | Marty et al. |
| 2019/0329114 | A1 | 10/2019 | Marty et al. |
| 2020/0074181 | A1* | 3/2020 | Chang ..... H04N 21/8456 |
| 2020/0098113 | A1 | 3/2020 | Marty et al. |
| 2020/0364462 | A1 | 11/2020 | Imes |
| 2021/0166010 | A1 | 6/2021 | Marty et al. |
| 2022/0122269 | A1 | 4/2022 | Marty et al. |
| 2022/0212077 | A1 | 7/2022 | Anton et al. |
| 2022/0415048 | A1 | 12/2022 | Marty et al. |
| 2024/0071140 | A1 | 2/2024 | Marty et al. |
| 2024/0087137 | A1 | 3/2024 | Marty et al. |

FOREIGN PATENT DOCUMENTS

| | | | |
|---|---|---|---|
| EP | 2271414 | B1 | 6/2014 |
| RU | 2026104 | | 1/1995 |
| WO | 9530872 | A1 | 11/1995 |
| WO | 9532033 | | 11/1995 |
| WO | WO-0125946 | A1 * | 4/2001 ..... A63B 24/0084 |
| WO | 2005062841 | | 7/2005 |
| WO | 2009126982 | A2 | 10/2009 |

* cited by examiner

BASKETBALL LAUNCHING DEVICE USING MACHINE VISION

CROSS-REFERENCE TO RELATED APPLICATIONS

This application is a continuation-in-part of U.S. application Ser. No. 17/160,929 filed Jan. 28, 2021 which is a continuation-in-part of U.S. application Ser. No. 16/894,005 filed Jun. 5, 2020, which claims the benefit of U.S. Provisional Patent Application No. 62/858,524 filed Jun. 7, 2019, the disclosures of each of which are hereby incorporated by reference as if fully restated herein.

TECHNICAL FIELD

Exemplary embodiments relate generally to a basketball launching device and related systems and methods for using machine vision to detect basketballs passing through a rim of a basketball goal.

BACKGROUND AND SUMMARY OF THE INVENTION

Basketball return machines exist which assist a basketball player by returning made shots, and usually at least some missed shots, to the player such that the player does not have to spend time retrieving the basketballs. This way, the player is able to fit more shots into a given practice session. Some basketball return machines use a guide or track to direct basketballs towards a player. Other basketball return machines use launching devices to eject basketballs in various directions on a playing area. Exemplary basketball return machines include, without limitation, THE GUN machines available from Shoot-A-Way, Inc. of Upper Sandusky, Ohio (shootaway.com/) and DR. DISH machines available from Airborne Athletics, Inc. of Minneapolis, Minnesota (www drdishbasketball.com/).

In order to provide the player with feedback regarding his or her shooting performance during a given practice session, detection devices are sometimes used to monitor the player's performance. Such detection devices may take the form of flappers which are placed along the route a basketball would take during or after passing through the rim and are physically moved or contacted when a basketball moves along such a route, thus indicating a successfully made shot. Such devices are subject to physical wear, jamming, and may disrupt the basketball's travel. Other exemplary detection devices include photo-eyes. Such photo-eyes may be mounted in close proximity to a basketball hoop and monitor for changes in the ambient light created when a basketball passes through the hoop. Such photo-eyes are subject to inaccurate readings due to changes in ambient lighting conditions which may be caused, for example, by the net shifting in front of the photo-eye, reflections, flash photographs, or lights being turned on or off. Additionally, all of the above detection devices may be difficult to appropriately position in relation to the basketball goal. What is needed is a basketball launching device that utilizes machine vision for detecting made shots.

A basketball launching device which utilizes machine vision for detecting made shots is provided. The basketball launching device may comprise one or more cameras. The basketball launching device may comprise an interface for selecting pass receipt locations on a playing area where basketballs will be ejected for a player to receive and shoot towards a basketball goal. The interface may comprise a rendering of a basketball playing area. The interface may be configured to receive a user's selection of one or more of a number of selectable areas on the rendering where the selectable areas are positioned to correspond with actual locations on the playing area so that the player knows where to stand to receive the ejected passes.

The camera(s) may be mounted on the basketball launching device and may be positioned to capture images of the underside of the rim. Alternatively, or additionally, the camera(s) may be positioned to capture images of an upper side of the rim. For example, without limitation, some or all of the cameras may be mounted to one of a number of support poles extending above the rim. The support poles may support netting for capturing some or all of the made and/or missed shots, though such is not necessarily required. The camera(s) may be located above and/or below the rim. The camera(s) may be positioned to directly view an upper or underside of the rim, or may be positioned at one or more angles relative to the rim. For example, without limitation, a single camera or multiple cameras may be provided which solely view an upper side of the rim. Alternatively, or additionally, a single camera or multiple cameras may be provided which solely view an under side of the rim. As yet another example, without limitation, multiple cameras may be provided which view and upper and underside of the rim.

Regardless, the camera(s) may be configured to capture images as basketballs are shot by a player towards the basketball goal. In exemplary embodiments, without limitation, the camera(s) may be configured to capture images of basketballs passing through the rim of the basketball goal. The camera(s) may be positioned and/or otherwise configured to capture the entire basketball rim. In exemplary embodiments, without limitation, the camera(s) are positioned and/or otherwise configured to capture a field of view not extending far from the basketball rim. For example, without limitation, the field of view may normally exclude areas more than a distance from a footprint of the basketball launching device (e.g., 1 foot, 3 feet, 18 inches, etc.).

The camera(s) may feed the captured images to a controller. The controller may comprise a machine learning model configured to determine if no basketball is detected within the image, a basketball is detected but has not passed through the rim, or a basketball is detected that has passed through the rim. A made shot may be determined where captured images are received with a basketball in the frame which has passed through the rim. Otherwise, a missed shot may be recorded. The machine learning model may comprise a neural network trained from a large dataset of images. The controller may record a made shot or a missed shot as determined by the model.

A performance report may be generated comprising percentages of successfully made shots for each pass receipt location the basketballs were ejected and/or shooting location where shots were taken. The performance report may comprise a rendering which may substantially match the rendering on the interface. The percentages of successfully made shots may be provided on the rendering of the performance report at the pass receipt location and/or the shooting locations the basketballs were ejected to so that a user can quickly asses their areas of strength and weakness.

In many cases, it may be desirable for users to practice shooting off the dribble. Such off the dribble shooting may include, for example without limitation, where a player takes a shot while moving or in an otherwise non-stationary position. Such off the dribble shooting may include, alternatively or additionally, as another example and without limitation, where the player takes a shot after performing a pre-shooting basketball move and/or performing such a pre-shooting basketball move immediately before receiving a pass and immediately taking a shot. Such pre-shooting basketball moves may include any athletic, basketball related movements other than movements between the various pass receipt locations of the shooting drill. For example, without limitation, such pre-shooting basketball moves may include performing a simulated cut between pass receipt locations but exclude simply walking, jogging, running, or otherwise directly moving between the pass receipt locations. Such off the dribble shooting may include, for example without limitation, types of basketball shots to be taken such as, but not limited to, layups (e.g., reverse layup, finger roll, tear drop, power layup, double clutch, combinations thereof, or the like), bank shot, putback and tip in, jump shots, slam dunks, fade away jumpers, combinations thereof, or the like. Such off of the dribble shooting may include, for example without limitation, other basketball actions taken pre- or post-receiving the pass, such as, but not limited to, movements (e.g., simulated or actual pick drill, roll, dodge, euro step, pro-hop, pro-hop euro step, power up, over-the head, combinations thereof, or the like) passing to another player or location (e.g., bounce pass, chest pass, over the head pass, touch pass, baseball pass, jump pass, blind pass, behind the back pass, combinations thereof, or the like), dribbling (e.g., cross over, between the legs dribble, behind the back dribble, wraparound, in and out dribble, v dribble, different heights dribble, ankle breaker dribble, hesitation move, combinations thereof, or the like), triple threat positions (e.g., pivot, jab step, pump fake, drawings contact, shuffle, combinations thereof, or the like), posting up (e.g., up and under, hook shot, drop step, power move, spin and dive, sikma move, dream shake, combinations thereof, of the like), two person games (e.g., give and go, dribble pitch or handoff, pick and roll, backdoor, alley-oop, combinations thereof, or the like), various combinations of the foregoing, or the like. Such off of the dribble shooting may include, for example without limitation, various drills incorporating one or more of the same. One or more of the foregoing examples may constitute a basketball move, for example without limitation. One or more of the foregoing examples, except for the types of basketball shots examples, may constitute a pre-shooting basketball move, for example without limitation. In exemplary embodiments, without limitation, such pre-shooting basketball moves comprise dribbling after receiving a pass from the launching device but before making a shooting attempt. Alternatively, or additionally, without limitation, such pre-shooting basketball moves comprise athletic movements of the user after making a shooting attempt at a first one of the pass receipt locations, but before making a shooting attempt at a second one of the pass receipt locations, that is not direct movement between the first and second one of the pass receipt locations and/or movement solely intended for transportation of the player between the first and second one of the pass receipt locations. Such pre-shooting basketball moves may be made immediately before and/or after receiving a pass at a pass receipt location.

In exemplary embodiments without limitation, such pre-shooting basketball moves may be those which are configured to simulate game conditions and may exclude exercise-related movements. For example, without limitation, the pre-shooting basketball move may be performed to simulate game conditions such as dribbling to get open, performing a juke, pick and roll, running off a pick, combinations thereof, or the like. As a further example, without limitation, such pre-shooting basketball moves may exclude purely exercise-related movements such as line drills, jogging laps, pushups, crunches, weight lifting, combinations thereof, or the like.

Such off the dribble shooting may be in contrast to stationary shots such as, but not limited to, free throws, planted feet shots, stationary catching and shooting attempts, combinations thereof, or the like. Such off of the dribble shooting may more realistically simulate game conditions, provide an increased workout, combinations thereof, or the like. However, particularly in an environment where shooting statistics are tracked and reported for the player or a third party to view, such as but not limited to, in a ranking across a team, group, multiple sessions, for a coach, parent, or other third party to view, a user may be reluctant to incorporate such off of the dribble shooting practice as their shooting performance statistics are likely to decrease due to the increased difficulty of such shooting attempts. Therefore, what is needed is separate tracking of off of the dribble shooting statistics.

Systems and methods are provided for tracking such off of the dribble shooting statistics, particularly in an automated fashion. Such systems and methods may track and/or provide such off of the dribble statistics in a manner which indicates the off of the dribble nature of such statistics or otherwise distinguishes such statistics from other shooting statistics. The interface associated with the basketball return machine may comprise options to select, or provide instruction for, such off of the dribble shooting. Such instructions may, in exemplary embodiments without limitation, be provided in the form of selectable areas, travel paths, and/or action markers. Shooting statistics for such off of the dribble shooting attempts may be separately tracked, or otherwise so categorized in a performance report such as by the controller and/or report generator. Such statistics may be tracked for the user across a team, group, multiple sessions, for a coach or third party to review. In exemplary embodiments, multiple such basketball launching devices may be utilized in a space, such as in a gym, and such statistics may be transmitted to a scoreboard at the space. The scoreboard may be configured to separately display such off of the dribble shooting statistics.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1A:
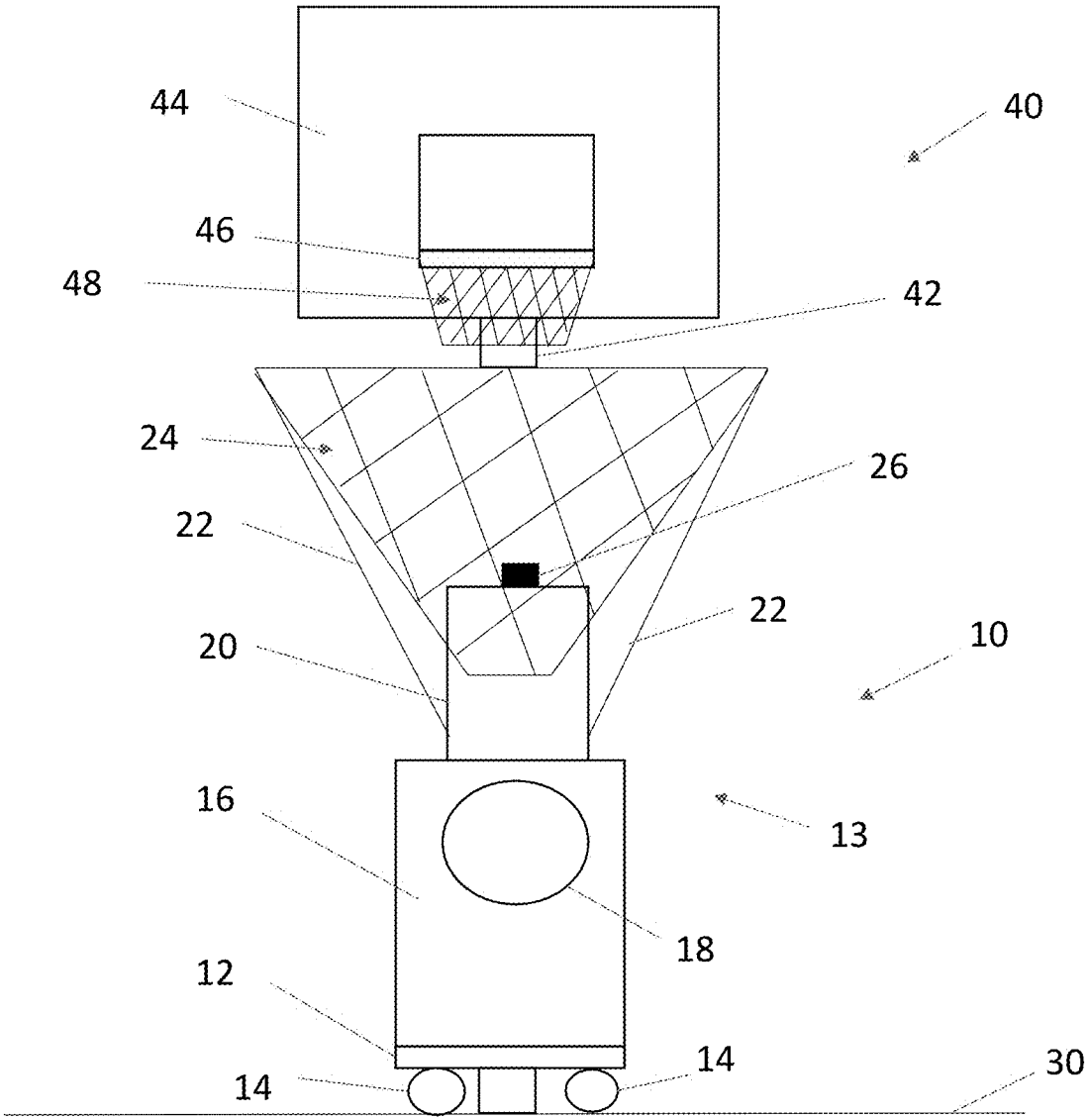
FIG. 1A is a front view of an exemplary basketball launching device having a camera-based detection system in accordance with the present invention located near a basketball goal on a playing area.
Figure 1B:
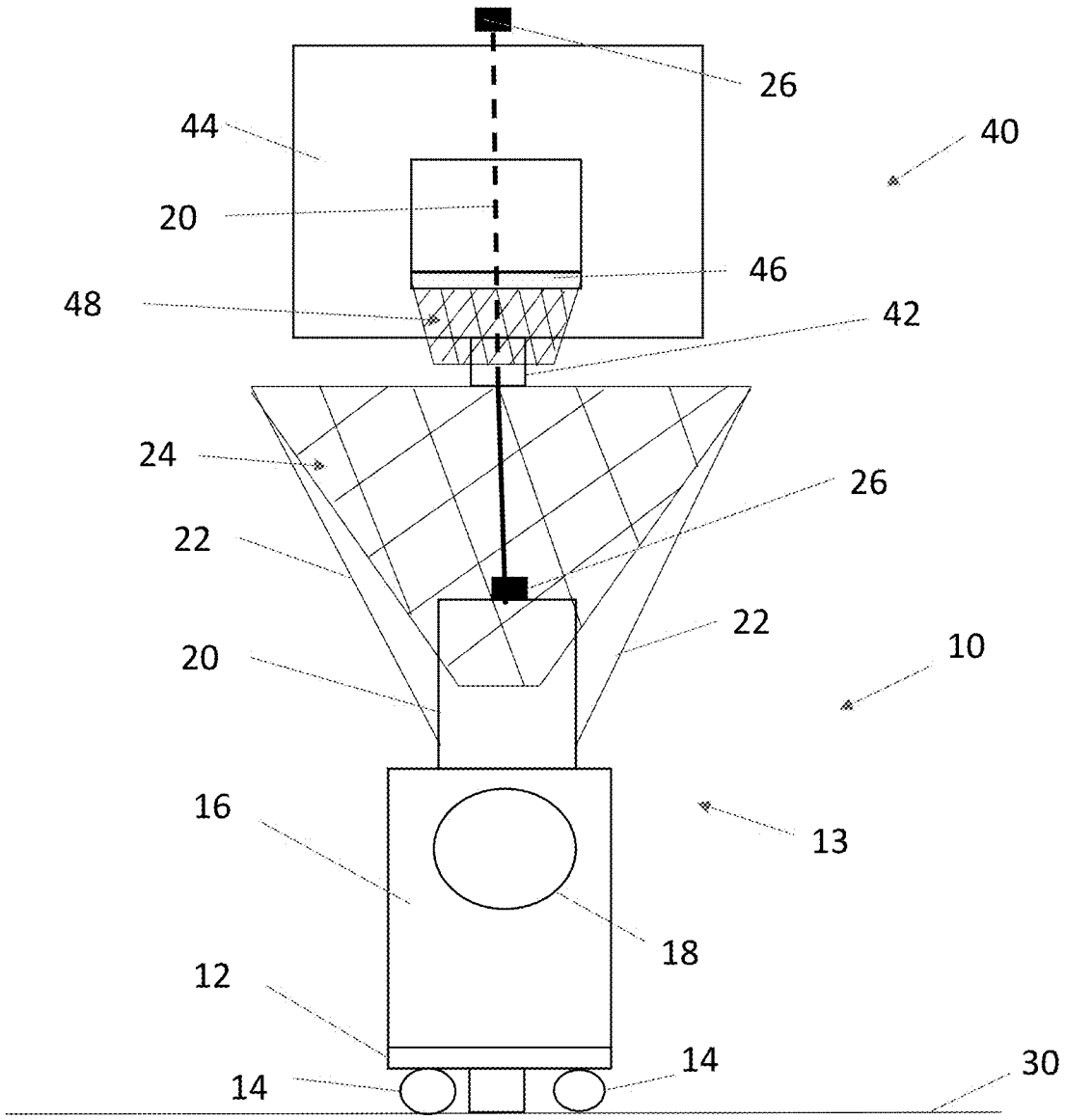
FIG. 1B is a front view of another exemplary embodiment of the basketball launching device of FIG. 1A.
Figure 1C:
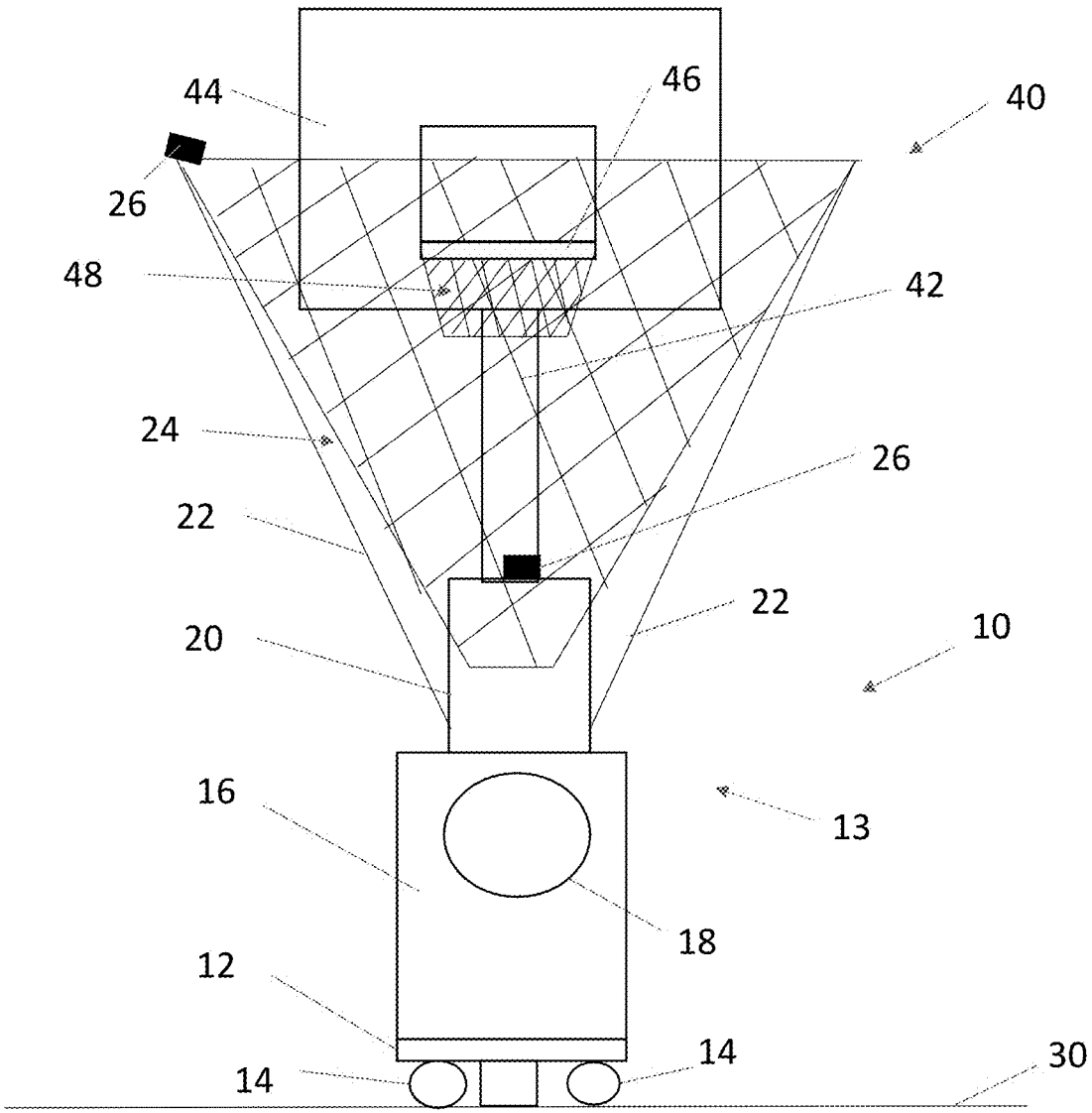
FIG. 1C is a front view of another exemplary embodiment of the basketball launching device of FIG. 1A.
Figure 2A:
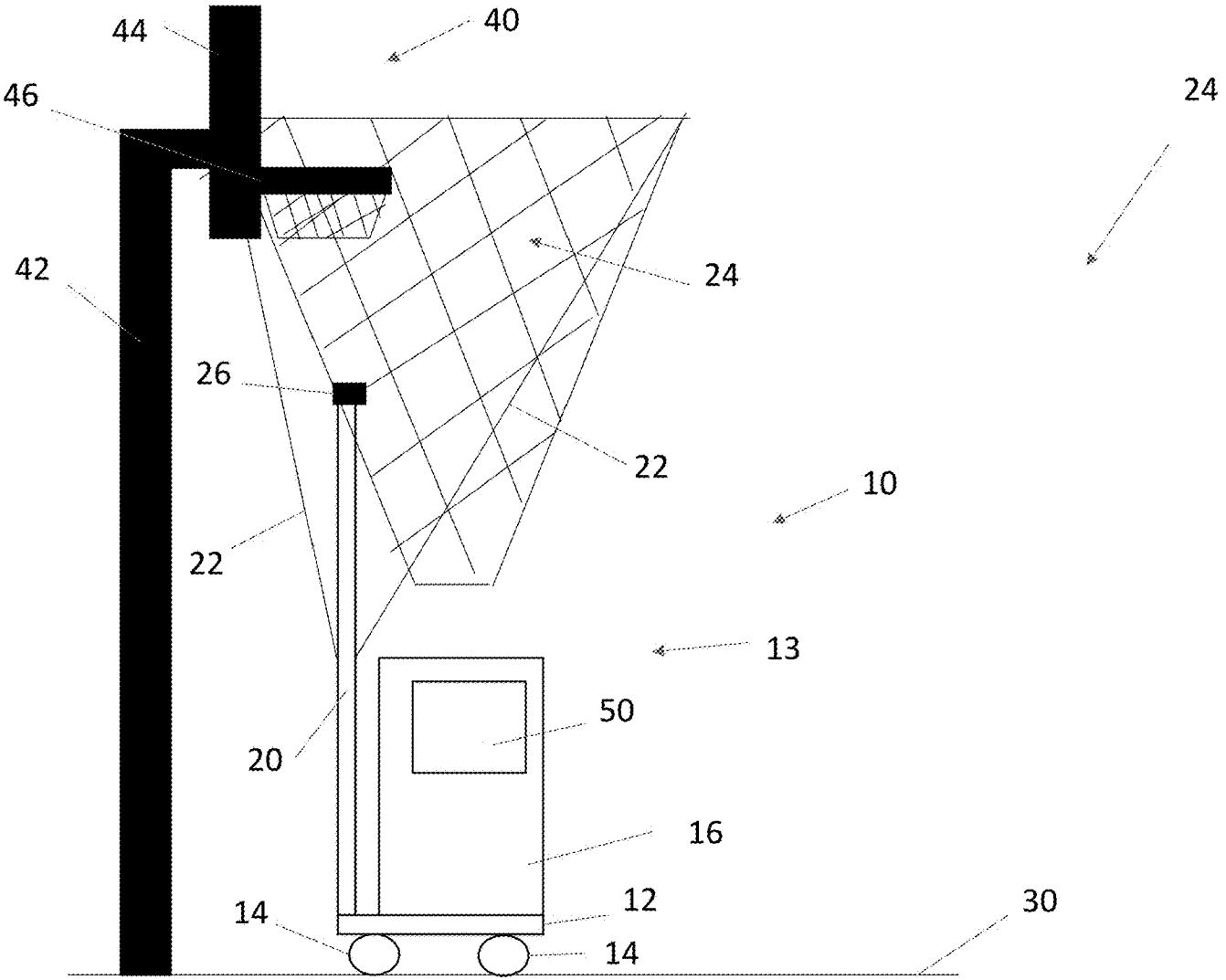
FIG. 2A is a side view of the FIG. 1A device.
Figure 2B:
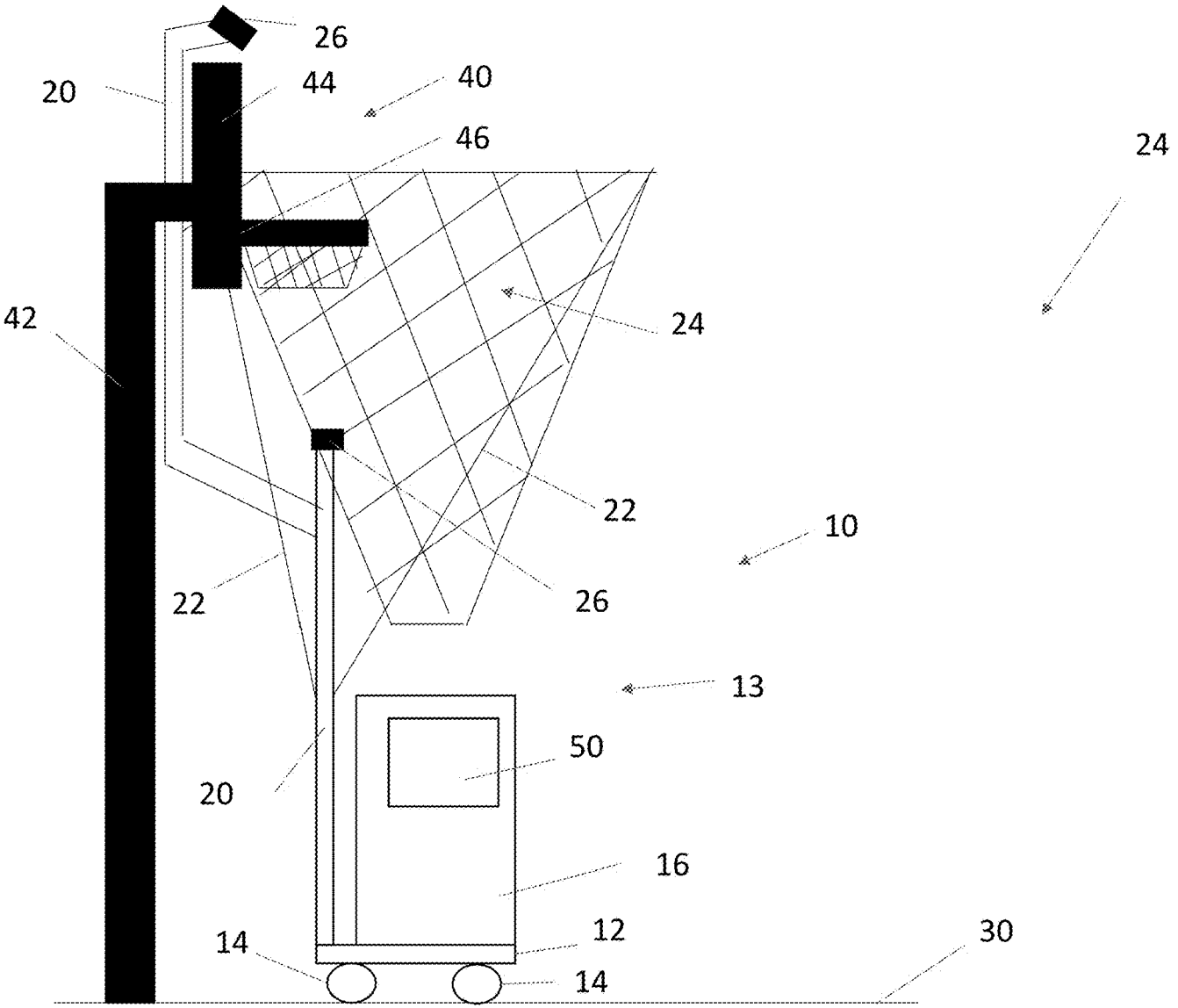
FIG. 2B is a side view of the FIG. 1B device.
Figure 2C:
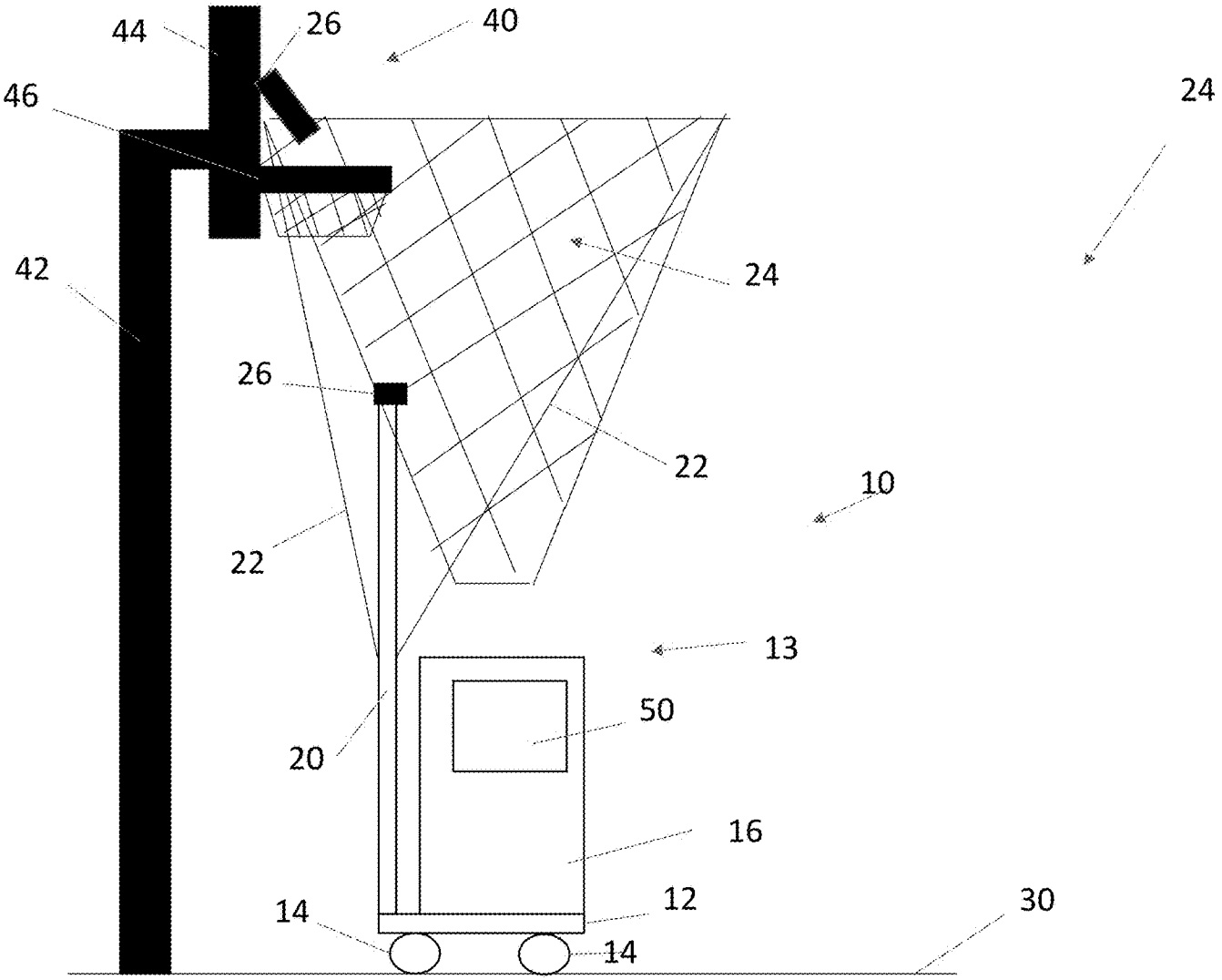
FIG. 2C is a side view of the FIG. 1C device.

FIG. 1A is a front view of an exemplary basketball launching device 10 and FIG. 2A is a side view of the basketball launching device 10. FIG. 1B is a front view of another exemplary embodiment of the basketball launching device 10 and FIG. 2B is a side view of the basketball launching device 10. FIG. 1C is a front view of another exemplary embodiment of the basketball launching device 10 and FIG. 2C is a side view of the basketball launching device 10.

The basketball launching device 10 may comprise a support structure 12. The support structure 12 may comprise a frame, platform, rigid members, combinations thereof, or the like. A number of wheels 14 may be mounted to the support structure 12 which permit movement of the basketball launching device 10 around a playing area 30. A housing 16 may be mounted to the support structure 12. The housing 16, in exemplary embodiments, may be mounted to the support structure 12 in a rotatable manner. One or more apertures 18 may be located in the housing 16. At least a first one of the apertures 18 may be sized to permit basketballs 60 to be ejected therethrough to various pass receipt locations at the playing area 30. The first one of the apertures 18 may be located on a front of the housing 16, though any location may be utilized. A second one of the apertures 18 may be located on an upper portion of the housing 16 and may be sized to permit the basketballs to enter the housing 16 through the second one of the apertures 18. In other exemplary embodiments, the housing 16 is not required or is provided outside the travel path of the basketball.

The support structure 12 may comprise a frame 20, at least a portion of which may extend vertically. At least a portion of the frame 20 may be collapsible, though such is not required. The frame 20 may comprise one or more support members 22. At least some of said support members 22 may be adjustable in length. In exemplary embodiments, at least some of the support members 22 may comprise telescoping poles. In exemplary embodiments, four support members 22 may extend upwardly and outwardly from the support structure 12 in a splayed fashion, though any number and configuration of support members 22 may be utilized. The support member 22 may, in exemplary embodiments, be selectively collapsible.

A net 24 may be attached to one or more of the support members 22. Openings in the net 24 may be sized to prevent the basketballs 60 from passing therethrough. The net 24 may be configured to create a funnel shape when mounted to said support members 22 such that basketballs 60 gathered in the net 24 are directed towards the housing 16 where they may be received through one or more openings, such as but not limited to, the second one of the apertures 18. However, any size, shape, and type of net 24 may be utilized. Alternatively, or in addition, one or more guide tracks may extend between the bottom of the net 24 and the housing 16.

The basketball launching device 10 may be placed in proximity to a basketball goal 40 by a user, such as directly below a rim 46 of the goal 40. The basketball goal 40 may be regulation type, height, size and configuration, though such is not required. The basketball goal 40 may comprise a post 42 which extends to the playing area 30, a backboard 44, the rim 46, and a net 48, for example without limitation. For example, without limitation, the rim 46 may be positioned 10 feet above the playing area 30.

Some or all of the frame 20 may be adjustable. For example, without limitation, the frame 20 may comprise one or more mechanisms for collapsing the support members 22, the net 24, and/or the frame 20. In this way, the basketball launching device 10 may be selectively reduced in size. In exemplary embodiments, the basketball launching device 10 may be sufficiently reduced in size so as to fit through a standard size doorway, though such is not required. As another example, without limitation, the frame 20 may comprise one or more mechanisms for expanding the support members 22, the net 24, and/or the frame 20. In this way, the basketball launching device 10 may be selectively increased in size. In exemplary embodiments, the basketball launching device 10 may be positioned and sufficiently increased in size such that one or more upper edges of the net 24 extend above the rim 46 of the basketball goal 40 when so positioned. When expanded, the net 24 may create a sufficiently sized top opening to accommodate most, or all, of a user's made shots as well as at least some, or all, of the user's missed shots, which are gathered by the net 24 and returned to the housing 16.

In still other exemplary embodiments, adjustment of the net 24 may be achieved by adjustment of the support members 22, with or without adjustment of the frame 20. FIG. 1 illustrates an exemplary configuration of the basketball launching device 10 with the net 24 positioned below the rim 46 and FIG. 2 illustrates an exemplary configuration of the basketball launching device 10 with the net 24 positioned above the rim 46 of the basketball goal 40. Any height of the net 24 in a collapsed and/or expanded position may be utilized.

The support structure 12, the housing 16, the support poles 22, and/or the frame 20 may, at least in part, define a structural subassembly 13. The structural subassembly 13 may comprise one or more of the support structure 12, the housing 16, the support poles 22, and/or the frame 20. The term structural subassembly 13 may therefore refer to such components, or subcomponents thereof, collectively or individually.

At least one camera(s) 26 may be mounted to the basketball launching device 10, such as but not limited to one or more components of the structural subassembly 13. In exemplary embodiments, the camera(s) 26 may be mounted to the frame 20. For example, without limitation, the camera(s) 26 may be mounted to an upper portion of the frame 20. The camera(s) 26 may be positioned to face upwardly, or at an upward angle. In this way, the camera(s) 26 may be located and oriented to capture a view of the underside of the rim 46 of the basketball goal 40 when the basketball launching device 10 is placed in proximity to the basketball goal 40. However, any location of the camera(s) 26 may be utilized, such as but not limited to, on the housing 16. The camera(s) 26 may, as another example without limitation, be mounted on one or more members which extend through the net 24. In other exemplary embodiments, the camera(s) 26 may be positioned on a portion of the frame 20 outside of the net 24. Regardless, the camera(s) 26 may be configured to capture images of rim 46 and any basketballs 60 passing therethrough. Stated another way, the camera(s) 26 may be configured to capture images of made shots.

Alternatively, or additionally, in exemplary embodiments, without limitation, one or more of the cameras 26 may be mounted to the basketball launching device 10, such as but not limited to one or more components of the structural subassembly 13, to view an upper side of the rim 46. For example, without limitation, the camera(s) 26 may be mounted to one or more of the support poles 22, such as at a portion extending or extendable above the rim 46. As another example, without limitation, the camera(s) 26 may be mounted to the backboard 44. As yet another example, without limitation, the camera(s) 26 may be mounted to a portion of the frame 20 extending, or extendable, above the rim 46. The portion of the frame 20 may extend behind or alongside some or all of the basketball goal 40, though such is not necessarily required, such as to avoid interfering with basketball shooting attempts by way of non-limiting example.

The camera(s) 26 may be positioned to face downwardly, or at a downward angle. In this way, the camera(s) 26 may be located and oriented to capture a view of the upper side of the rim 46 of the basketball goal 40 when the basketball launching device 10 is placed in proximity to the basketball goal 40. However, any location of the camera(s) 26 may be utilized, such as but not limited to, on the housing 16. The camera(s) 26 may, as another example without limitation, be mounted on one or more members which extend, or are extendable, through the net 24. In other exemplary embodiments, the camera(s) 26 may be positioned on a portion of the frame 20 outside of the net 24. Regardless, the camera(s) 26 may be configured to capture images of rim 46 and any basketballs 60 passing therethrough. Stated another way, the camera(s) 26 may be configured to capture images of made shots.

A single or multiple camera(s) 26 may be positioned to view either or both of an underside and upper side of the rim 46. In this fashion, the camera(s) 26 may be positioned to view images of basketballs passing through the rim 46, thereby indicating a made shot. In this way, the camera(s) 26 may be less, or not, susceptible to interference from overhead or other ambient lighting, differently colored ceilings, combinations thereof, or the like, by way of non-limiting example.

The camera(s) 26 may be mounted to the frame 20 or other component of the basketball launching machine 10 in an adjustable fashion. The camera(s) 26 may be mounted to the frame 20 or other component of the basketball launching machine 10 in a detachable fashion. In other exemplary embodiments, the camera(s) 26 may be permanently affixed to the frame 20 or other component of the basketball launching machine 10.

In other exemplary embodiments, other types of detectors for detecting made shots may be provided at, or in association with, the basketball launching machine 10 in place of, or in combination with, the camera(s) 26 at the same or different locations as the camera(s) 26. Such detectors may comprise, for example without limitation, photo eyes, flappers, audio sensors, proximity detectors, combinations thereof, or the like. Such detectors may be provided on the basketball launching machine 10, such as on the frame 20, the housing 16, combinations thereof, or the like. Alternatively, or additionally, such detectors may be in electronic communication with the basketball launching machine 10 or components thereof, the electronic devices 70, combinations thereof, or the like such as but not limited to, by way of wired or wireless connections.

An interface 50 may be provided for receiving user input and/or displaying information. The interface 50 may comprise one or more physically depressible buttons, electronic icons capable of direct or indirect selection, one or more electronic displays, one or more touch screens, combinations thereof, or the like. The interface 50 may be connected to the frame 20. Alternatively, the interface 50 may be mounted to the housing 16 or other component of the basketball launching machine 10. Any size, shape, or location of the interface 50 may be utilized. Alternatively, or additionally, the interface 50 may be provided on one or more personal electronic devices 70 such as, but not limited to, a smartphone, a tablet, a personal computer, some combination thereof, or the like. Such personal electronic devices 70 may be physically separate from the basketball launching machine 10 or physically integrated therewith. For example, without limitation, the personal electronic devices 70 may be permanently mounted to one or more components of the basketball launching machine 10. In other exemplary embodiments, the personal electronic devices 70 may be configured for selective and/or temporary mounting to the frame 20, housing 16, or other component of the basketball launching machine 10 such as, but not limited to, by way of a holder or mounting device.

Figure 3:
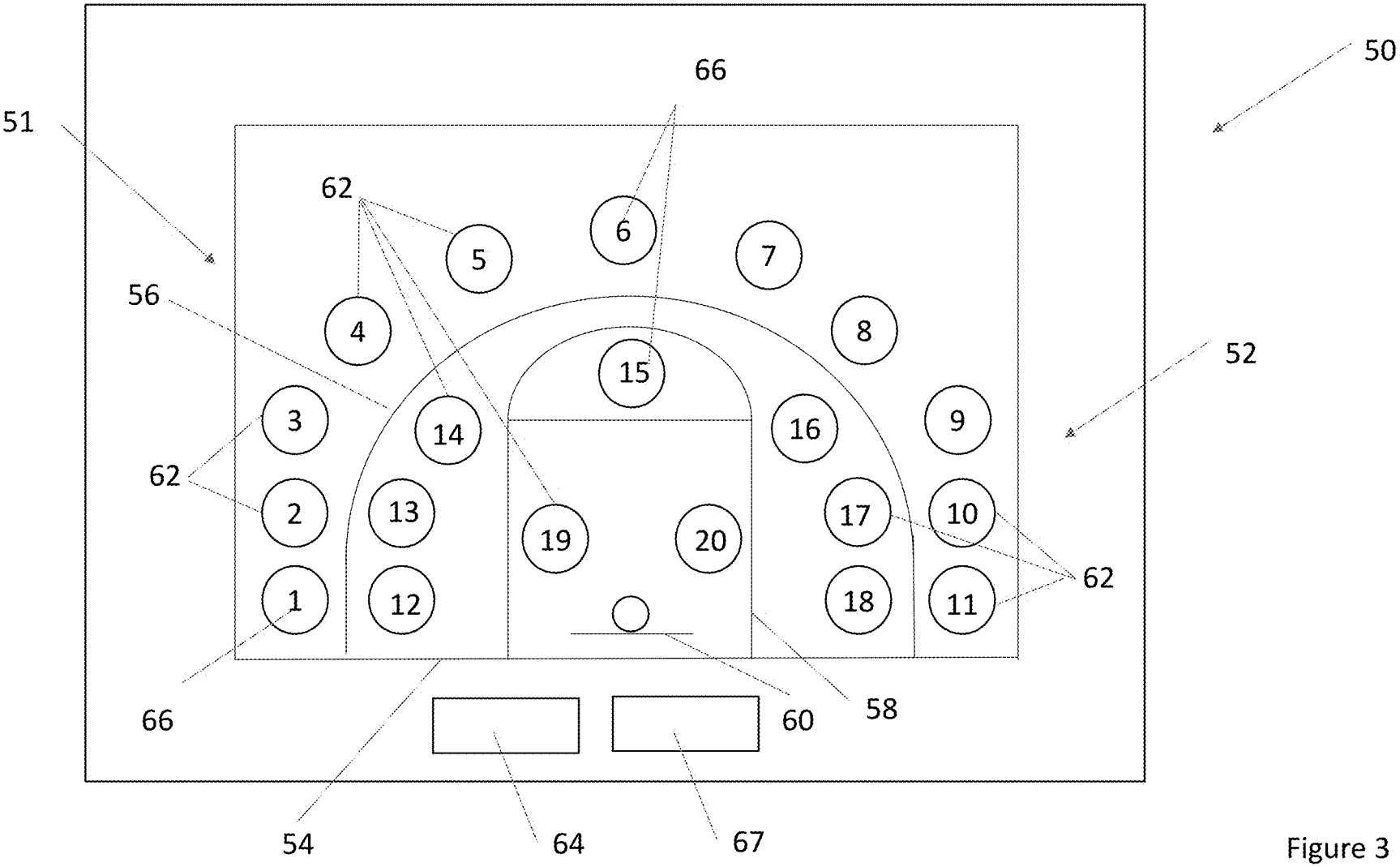
FIG. 3 is a front view of an exemplary location selection display.

FIG. 3 is a detailed view of the interface 50 with an exemplary location selection display 51. The interface 50 may comprise a rendering, illustration, or other visual depiction 52 of elements of an exemplary playing area 30, such as but not limited to a regulation basketball court. The visual depiction 52 may comprise, for example without limitation, depictions of a baseline, a key, a three-point arc, a basketball goal, combinations thereof, or the like. Any size, shape, arrangement, type, or kind of such basketball playing area elements or regulation or non-regulation type playing areas may be provided as part of the visual depiction 52 on the interface 50.

The location selection display 51 may comprise a number of selectable areas 62. The selectable areas 62 may be located at various positions on the visual depiction 52 to correlate with pass receipt positions on the playing area 30. The selectable areas 62 may be selected by the user to create custom shooting arrangements. The selectable areas 62, in exemplary embodiments, may be visually depicted as indicia such as but not limited to a circle though any size, shape, color, type, or the like of such selectable areas 62 may be utilized.

In exemplary embodiments, the interface 50 may comprise a touch screen. In such embodiments, the visual depiction 52 may be electronically generated electronic icons at the touch screen. The selectable areas 62, in such embodiments, may already be visible on the interface 50, such as in the form of indicia or icons, and may change when selected. In other such embodiments, the selectable area 62, such as in the form of indicia or icons, may not be visible and may become visible when the corresponding area of the interface 50 is selected. Such selection may be performed by direct, individual, physical contact, though such is not required. The touch screen may comprise a resistive, capacitive, or other type of touch screen. Some or all of the selectable areas 62 may be physically and/or electrically separated from one another or may be part of an undivided touch screen, display, panel, or the like.

In other exemplary embodiments, the interface 50 may comprise an electronic display. In such embodiments, the visual depiction 52 may be electronically generated on the electronic display. The selectable areas 62, in such embodiments, may already be visible on the interface 50, such as in the form of indicia or icons, and may change when selected. Such selection may be performed by one or more selection devices 64. Such selection devices 64 may permit interaction with the images displayed on the electronic display. For example, without limitation, such selection devices 64 may comprise a keypad, mouse, buttons, arrows, some combination thereof, or the like. The electronic display may comprise an LCD, cathode ray, OLED, plasma, or other type of electronic display.

In still other exemplary embodiments, the interface 50 may comprise a static panel. In such embodiments, the visual depiction 52 may be painted, printed, integrally formed, or otherwise provided on the interface 50 in a permanent or semi-permanent fashion. The selectable areas 62, in such embodiments, may comprise buttons. The selectable areas 62 may comprise illumination devices or the like which are configured to indicate whether the selectable areas 62 have been selected by a user. Such selection may be performed by direct, individual, physical contact, though such is not required.

Once selected, the selected ones of the selectable areas 62 may be changed, such as by illumination, highlighting, color changes, appearance, disappearance, shape change, number or other indication change, filled in, combinations thereof, or the like.

The selectable areas 62 may be provided at various locations on the visual depiction 52. The selectable areas 62 may be circular in shape, though any size and shape selectable areas 62 may be utilized. The selectable areas 62 may be located at spaced angular positions along the visual depiction 52. For example, without limitation, a number of selectable areas 62 may be positioned on or along the visual depiction of the three-point arc 56. In exemplary embodiments, some of the selectable areas 62 may be located inside the three-point arc 56 and other selectable areas 62 may be located outside of the three-point arc 56, though such is not required. Alternatively, or in addition, some or all of the selectable areas 62 may be located within or around the visual depiction of the key 58. The selectable areas 62 may, alternatively or additionally, be provided in visual correlation to a visual depiction of a baseline 54. Any size, shape, number, or arrangement of selectable areas 62 may be utilized.

Each of the selectable areas 62 may comprise one or more markers 66. The markers 66 may comprise numbers, letter, symbols, some combination thereof or the like. The markers 66 may provide nomenclature for the selectable areas 62 as well as the corresponding shooting positions on the playing area. The interface 50 may be configured to monitor for, and/or receive, a user selection of one or more of the selectable areas 62 to create a custom basketball practice arrangement. The selectable areas 62 may be individually selected by physical touch in a direct or indirect manner. The selectable areas 62 may form input locations for receiving user input.

Alternative or in addition to the embodiments described herein, a number of predetermined sets of selectable areas 62 may be preprogrammed to define pre-made practice arrangements. Such pre-made practice arrangements may be made available by way of certain ones of said selectable areas 62. In such embodiments, the interface 50 may be configured to permit the user to select one or more such predetermined programs as an alternative to, or in addition to, creating a custom practice arrangement.

The selectable areas 62 may be arranged on the visual depiction 52 to visually correspond with pass receipt locations at the playing area. In this way, the player knows where to stand to receive passes from the basketball launching machine 10 and the player is able to select particular areas to focus on, such as areas of weakness. The selectable area 62 may be provided on a 1:1 basis with such pass receipt locations, though any ratio may be utilized.

The interface 50 may comprise one or more areas 67 for selecting additional options such as, but not limited to, a time delay between passes, a number of basketballs per location, and the like. In exemplary embodiments, the separate area(s) 67 may not be required and such options may be selected at the area with the visual depiction 52. The areas 67 may be part of the interface 50, or be separate therefrom. The areas 67, for example without limitation, may comprise further selectable areas of a touch screen, icons on an electronic display, dedicated button(s), combinations thereof, of the like.

Figure 3B:
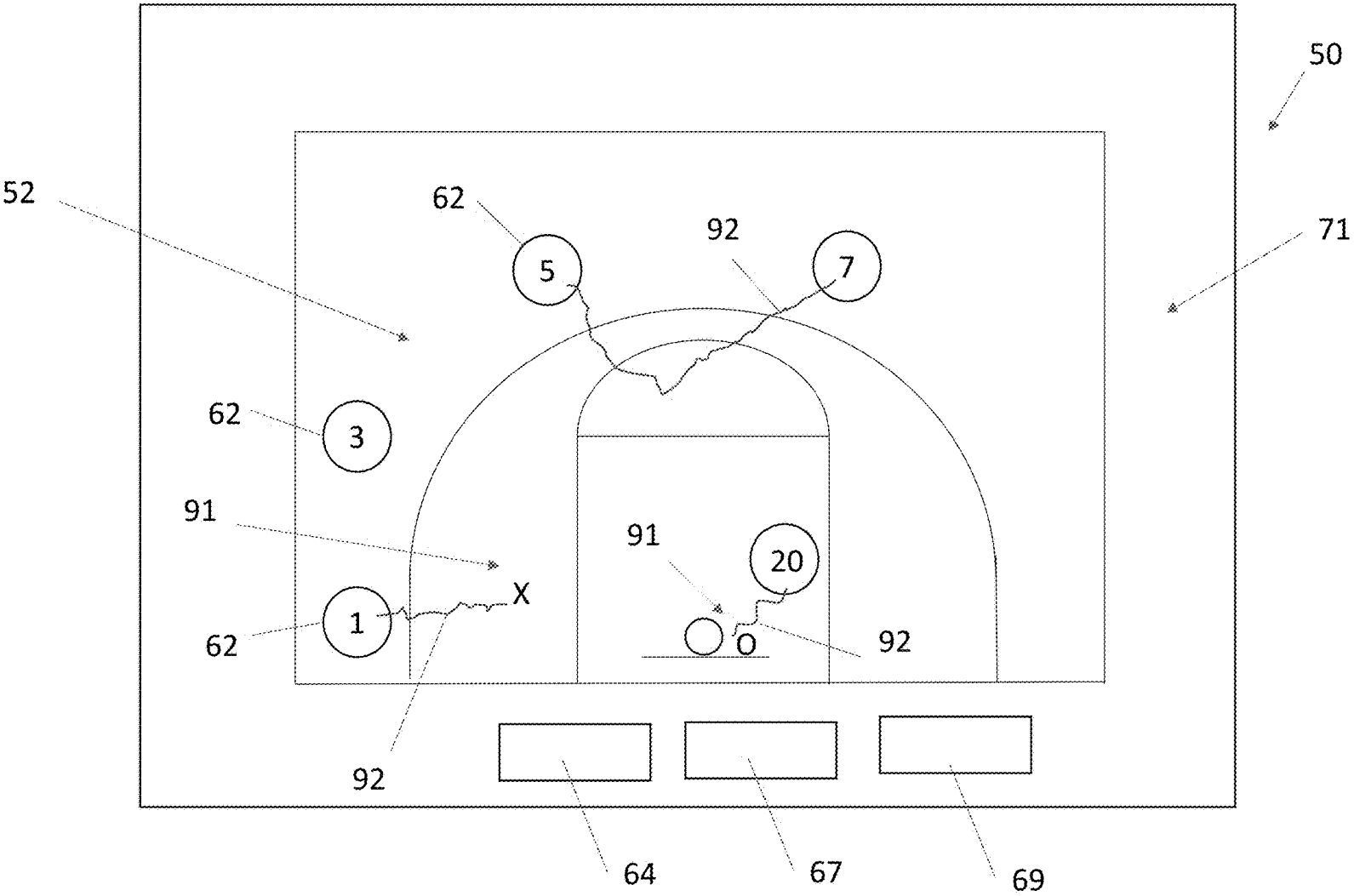
FIG. 3B is a front view of an exemplary off of the dribble display.
Figure 3C:
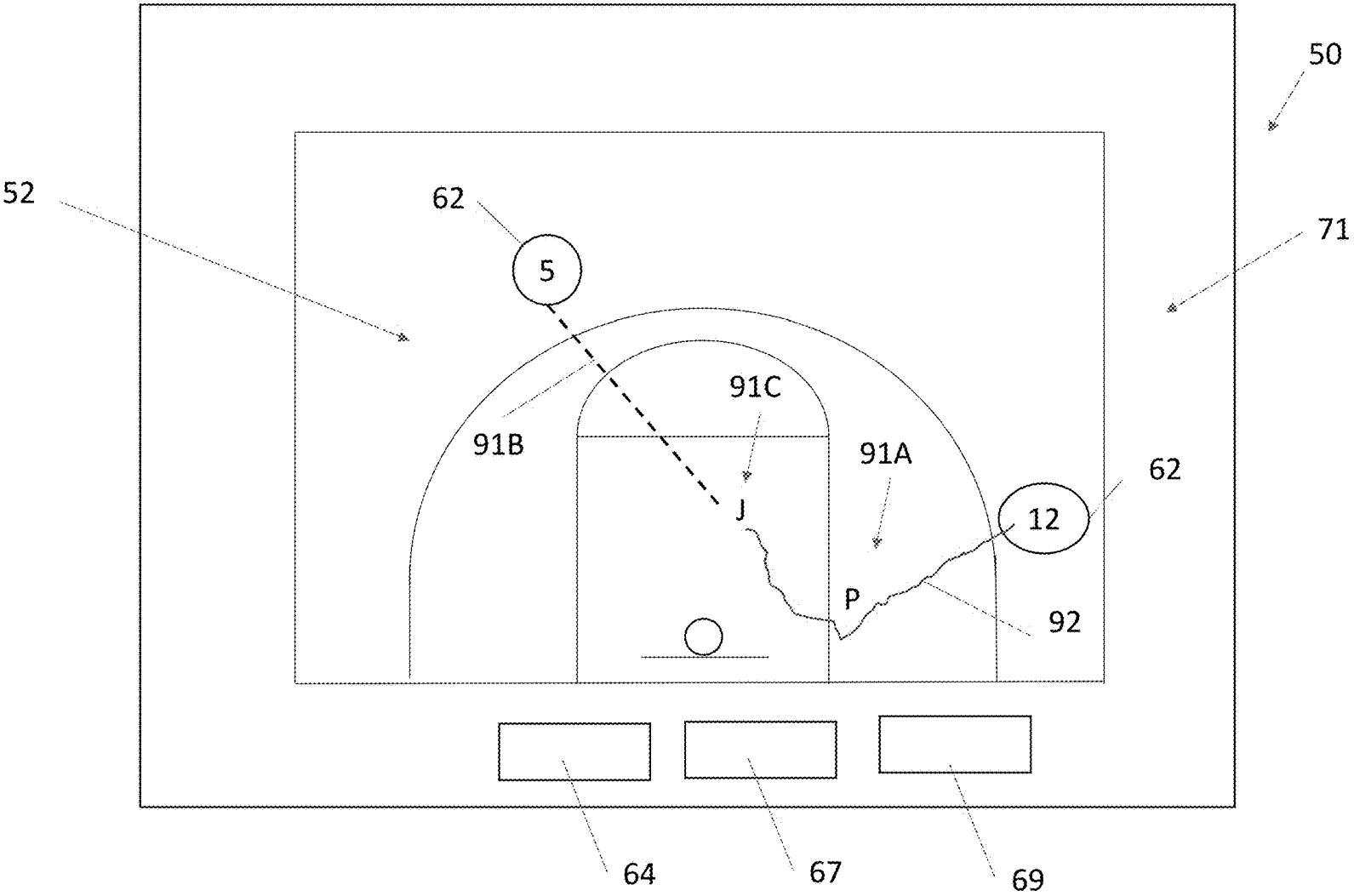
FIG. 3C is a front view of another exemplary off of the dribble display.

FIG. 3B and FIG. 3C are detailed views of the interface 50 with exemplary off of the dribble displays 71. In exemplary embodiments, the interface 50 may be configured to display travel paths 92 for a player 72. The travel paths 92, for example without limitation, may be displayed as straight lines, squiggle lines, color coded lines, dashed lines, other symbols, line type, colors, combinations thereof, or the like. The travel paths 92 may be configured to convey instructions to the player 72 on locations to run or otherwise travel to before or after receiving a basketball pass from the basketball launching machine 10 at a given one of the pass receipt locations forming part of the custom basketball practice arrangement. The travel paths 92 may comprise out-and-back paths, such as the travel path 92 shown from pass receipt location labeled "1" in the illustrated embodiment. The travel paths 92 may comprise shooting paths, such as the travel path 92 shown from a pass receipt location marked "20" in the illustrated embodiment to a shooting location closer to the visual depiction 52 of the basketball goal, which may indicate that the player 72 should perform a layup shot. The travel paths 92 may comprise routes between pass receipt locations, such as the travel path 92 between pass receipt locations labeled "5" and "7" in the illustrated embodiment. Of course, the illustrated embodiment is merely exemplary and is not intended to be limiting. Any number or type of travel paths 92 between any number of locations may be utilized. Likewise, any way of representing the travel paths 92 may be utilized. The travel paths 92 may be provided with some or all of the selectable locations 62 selected by the user and forming part of the custom basketball practice arrangement. The type of travel paths 92 displayed may be pre-selected or may be determined by the user.

Additionally, or alternatively, action markers 91 may be provided at the off of the dribble display 71 to indicate certain types of shots to be performed before and/or after receiving a basketball pass from the basketball launching device 10. Such action markers 91 may be provided at, or in association with, some or all of the selectable locations 62 selected by the user and forming part of the custom basketball practice arrangement. The type of actions indicated by the action markers 91 may be predetermined or may be selected by the user. The action markers 91 may convey pre- or post-pass receipt actions to be performed by the user and to be recorded accordingly. Such post pass receipt actions may include, for example without limitation, taking a certain type of shot, dribbling the basketball, passing the basketball to a second player who takes one or more particular actions pre- and/or post-receiving the pass from the first player, combinations thereof, or the like. For example, without limitation, such post pass receipt actions may include a drill where a first player receives a pass at the top of the key and passes to a second player coming off a real or simulated pick closer to the basket. Such passes may be indicated by dashed lines as shown with regard to FIG. 3C, though any such indication may be utilized.

In the example shown in FIG. 3C, the first player may stand at or near a location on the basketball playing area 30 corresponding to selectable area 62 labeled "5" to receive a pass from the basketball launching device 10. A second player may stand at or near a location on the basketball playing area 30 corresponding to selectable area 62 labeled "12", travel as indicated by travel path 92 off a simulated pick as indicated by the action marker 91A labeled "P", to receive a pass from the first player as indicated by the action marker 91B in dashed line from where the second player performs a jump shot as indicated by the action marker 91C labeled "J". This example is provided without limitation. Any known or yet to be developed drills or other actions may be incorporated into such off of the dribble displays 71. Selection of such drills may be made by selection of pre-programmed options at said off of the dribble selection area 69 or other portion of said interface 50, and/or creation of custom such drill at said off of the dribble selection area 69 or other portion of said interface 50. The labels for such action markers 91 and other items shown and/or described herein are merely exemplary and are not intended to be limiting. Any description, abbreviation, image, animation, icon, symbol, alphanumeric character(s), line type, colorization, combinations thereof, or the like may be used as action markers 91 to represent any type of kind of action. Different or the same such action markers 91 may be used to represent the same or different kinds of actions. Such action markers 91 may be changed periodically, such as according to user preference. A legend display may be selectively displayed to a user to demonstrate the meaning of each such action marker 91. In exemplary embodiments, some or all of such instructions may be provided by way of live or pre-recorded audio and/or video played at or through the interface 50 or related device(s).

An off the dribble selection area 69 may be provided at the off the dribble display 71. The off the dribble selection area 69 may permit a user to select certain pre- or post-passing options which affect the travel paths 92 and/or action markers 91 displayed such as type, length, and number of travel paths, pre-programmed options, shot types, post pass receipt actions, pass receipt locations for such selectable areas 62, travel paths 92, and/or action markers 91, combinations thereof, or the like. Such options may be presented in a menu format. Alternatively, or additionally, such options may be selected by a click and drag, tracing, scrolling, swiping, or other movement at the interface 50, particularly where said interface 50 comprises a touch screen, and/or at said selection devices 64. The off of the dribble selection area 69 may be physically and/or electronically separated from the off of the dribble display 71 or form a part thereof.

The off the dribble selection area 69 may be provided as a prompt upon selection of a selectable area 62, selection of an icon or other marker representing the same, or as a separate option or menu area of the interface 50. The off the dribble selection area 69 may comprise an option for the user to designate shots associated with a given one of the selectable areas 62, and the associated pass receipt location, as being associated with an off the dribble shooting attempt. Such selection may be relayed to the controller 68 which may be configured to cause all made/missed data received from the detectors, such as but not limited to the camera(s) 26, to be recorded with an indication that such data is associated with off the dribble shooting attempts. This may permit the separate tracking and display of statistics related to such off the dribble shooting attempts.

The travel paths 92 and/or action markers 91 may be used to convey instructions to the player to perform at the playing area 30 as part of the custom basketball practice routine. These may be used to simulate game conditions, provide an enhanced workout, perform certain drills, combinations thereof, or the like.

Examples of such items which may be indicated by the travel paths 92 and/or action markers 91 and/or selected at the off the dribble section area 69 and/or interface 50 include, but are not limited to, types of basketball shots to be taken such as, but not limited to, layups (e.g., reverse layup, finger roll, tear drop, power layup, double clutch, combinations thereof, or the like), bank shot, putback and tip in, jump shots, slam dunks, fade away jumpers, other basketball actions taken pre- or post-receiving the pass, such as, but not limited to, movements (e.g., simulated or actual pick drill, roll, dodge, euro step, pro-hop, pro-hop euro step, power up, over-the head, combinations thereof, or the like) passing to another player or location (e.g., bounce pass, chest pass, over the head pass, touch pass, baseball pass, jump pass, blind pass, behind the back pass, combinations thereof, or the like), dribbling (e.g., cross over, between the legs dribble, behind the back dribble, wraparound, in and out dribble, v dribble, different heights dribble, ankle breaker dribble, hesitation move, combinations thereof, or the like), triple threat positions (e.g., pivot, jab step, pump fake, drawings contact, shuffle, combinations thereof, or the like), posting up (e.g., up and under, hook shot, drop step, power move, spin and dive, sikma move, dream shake, combinations thereof, of the like), two person games (e.g., give and go, dribble pitch or handoff, pick and roll, backdoor, alley-oop, combinations thereof, or the like), various combinations of the foregoing, or the like. This list is merely exemplary and is not intended to be limiting. Any type or kind of such actions, already known or yet to be developed, may be selected, displayed, and or tracked in the same or separate categories.

In exemplary embodiments, these various pre- and/or post-pass receipt actions as indicated by the travel paths 92 and/or the action markers 91 may be tracked in a single off of the dribble category separate from, or selectively separable from, other shooting statistics. Alternatively, or additionally, each of the various pre- and/or post-pass receipt actions as indicated by the travel paths 92 and/or the action markers 91 may be tracked in their own subcategory of off of the dribble category separate from, or selectively separable from, other shooting statistics.

In exemplary embodiments, without limitation, the machine 10 may be configured to increase a time between launching basketballs for each of said pass receipt locations selected by the user at the interface 50 where the user also indicated an association with off the dribble shooting attempts. This may provide the user with additional time to complete one or more basketball moves immediately before or after receiving the basketball pass at the respective one of the pass receipt locations. The time increase may be added to a default timing and/or a programmed timing indicated by the user at the interface 50. The time increase may be a predetermined amount, such as but not limited to a number of seconds, or may be manually programmed by the user at the interface 50. The timing increase may apply only to those pass receipt locations that the user has indicated, such as by way of the interface 50, an association with off the dribble shooting attempts. In other exemplary embodiments, such as where selection of a pre-programmed subset of pass receipt locations and/or drill is selected, the timing increase may be automatically applied to any pass receipt locations in the pre-programmed subset or drill associated with such off the dribble shooting attempts. Alternatively, or additionally, the speed at which basketballs are launched may be decreased for such pass receipt locations associated with off the dribble shooting attempts to accomplish an increased delay between such passes.

In exemplary embodiments, without limitation, one or more pre-made practice arrangement options may be provided at said interface 50. Each of these pre-made practice arrangement options may comprise a subset of the pass receipt locations and/or one or more off the dribble selections already associated with certain of said pass receipt locations in said subset.

Figure 4:
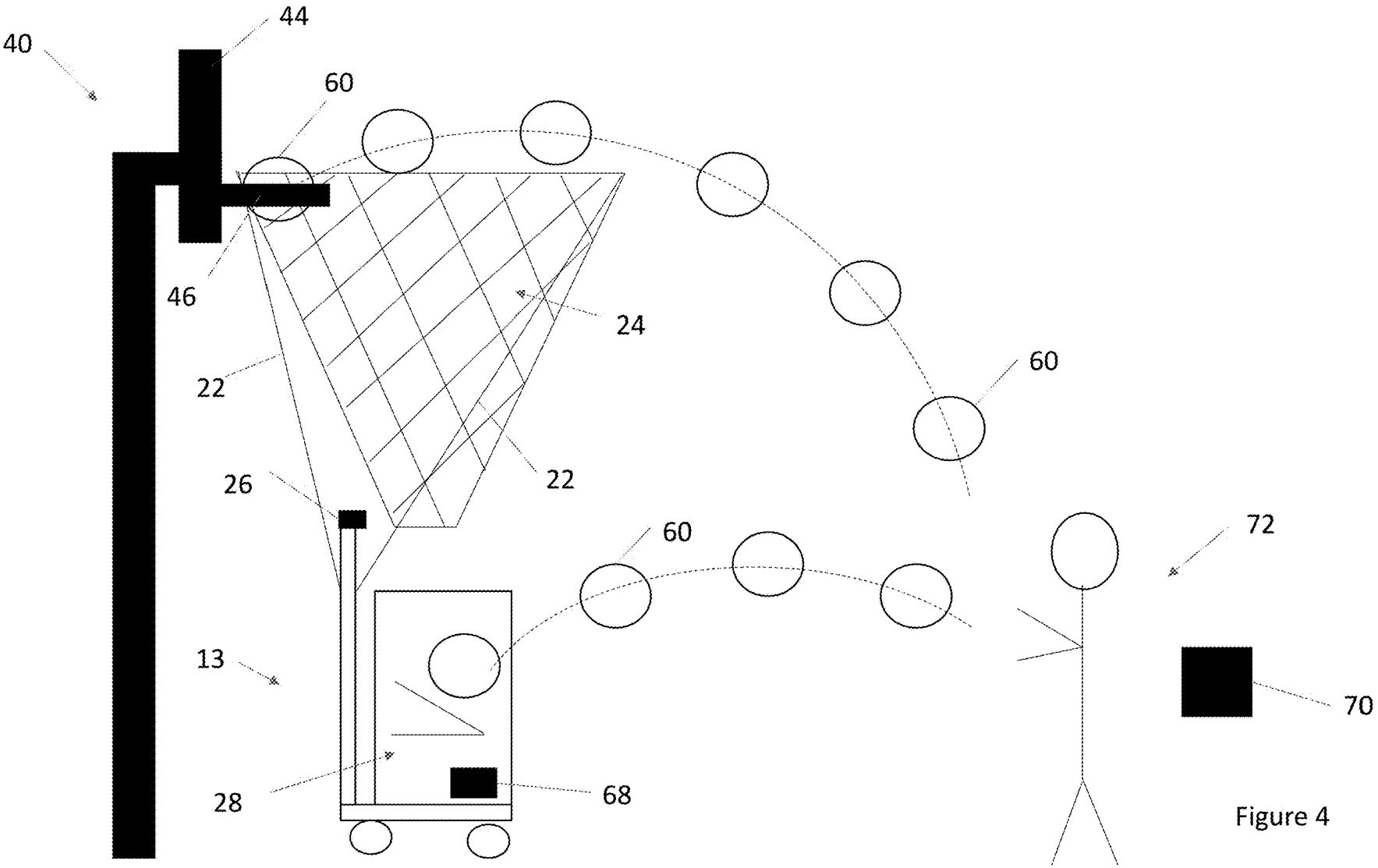
FIG. 4 is a side view of the basketball launching device with certain elements of the basketball launching device removed to illustrate additional components, exemplary basketballs are also illustrated.

FIG. 4 is a side view of the basketball launching device 10 with certain elements of the housing 16 removed to illustrate the launcher 28. The launcher 28 may be configured to launch one or more basketballs 60 to one or more pass receipt locations at the playing area 30 for a player 72 to catch and shoot towards the basketball goal 40. For example, without limitation, the launching device 28 may comprise a catapult arm, thrower, wheeled device, some combination thereof, or the like. Any kind or type of launching device 28 may be utilized. The launcher 28 may be mounted to the housing 16 and/or the support structure 12 in a rotatable manner, though such is not required.

The interface 50 may be placed in electronic communication with a controller 68. The controller 68 may be located at the housing 16, though any location of the controller 68 may be utilized, including but not limited to at a remote location such as a server and/or personal electronic device 70. The controller 68 may comprise one or more electronic storage devices with executable software instructions and one or more processors. Alternatively, or in addition, the controller 68 may be part of one or more other components of the basketball launching device 10 including but not limited to, the camera(s) 26 and the interface 50. The controller 68 may be configured to receive electronic signals from the interface 50 regarding the user's selection of the selectable areas 62 to form a custom practice arrangement and may program the launcher 28 to pass basketballs 60 to each of the pass receipt locations at the playing area 30 corresponding to each of selectable areas 62 selected by the user at the interface 50 to perform the custom practice arrangement. The controller 68 may be configured to, alternatively or additionally, receive input from the interface 50 including user selection of the selection devices 64, area 67, off of the dribble selection area 69, pre-programmed drill, user preferences, other options, some combination thereof, or the like and program the launcher 28 and/or display such user selections at the interface 50 in accordance with the received input.

The basketball launching device 10 may be positioned in proximity to the basketball goal 40 such that the basketballs 60 passing through the rim 46, and at least some of the basketballs 60 bouncing off the backboard 44 but not necessarily passing through the rim 46 or otherwise resulting in a missed shot (i.e., not passing through the rim 46), may be captured in the net 24. The camera(s) 26 may be positioned to face upwardly at the bottom of the rim 46. In this way, the camera(s) 26 may be configured to capture an image of the basketball rim 46 with no basketball (no ball in frame), an image of the basketball rim 46 and the basketball 60 failing to pass completely through the rim 46 (an attempted shot), or an image of the basketball 60 as it passes through the rim 46 (made shot).

Figure 5A:
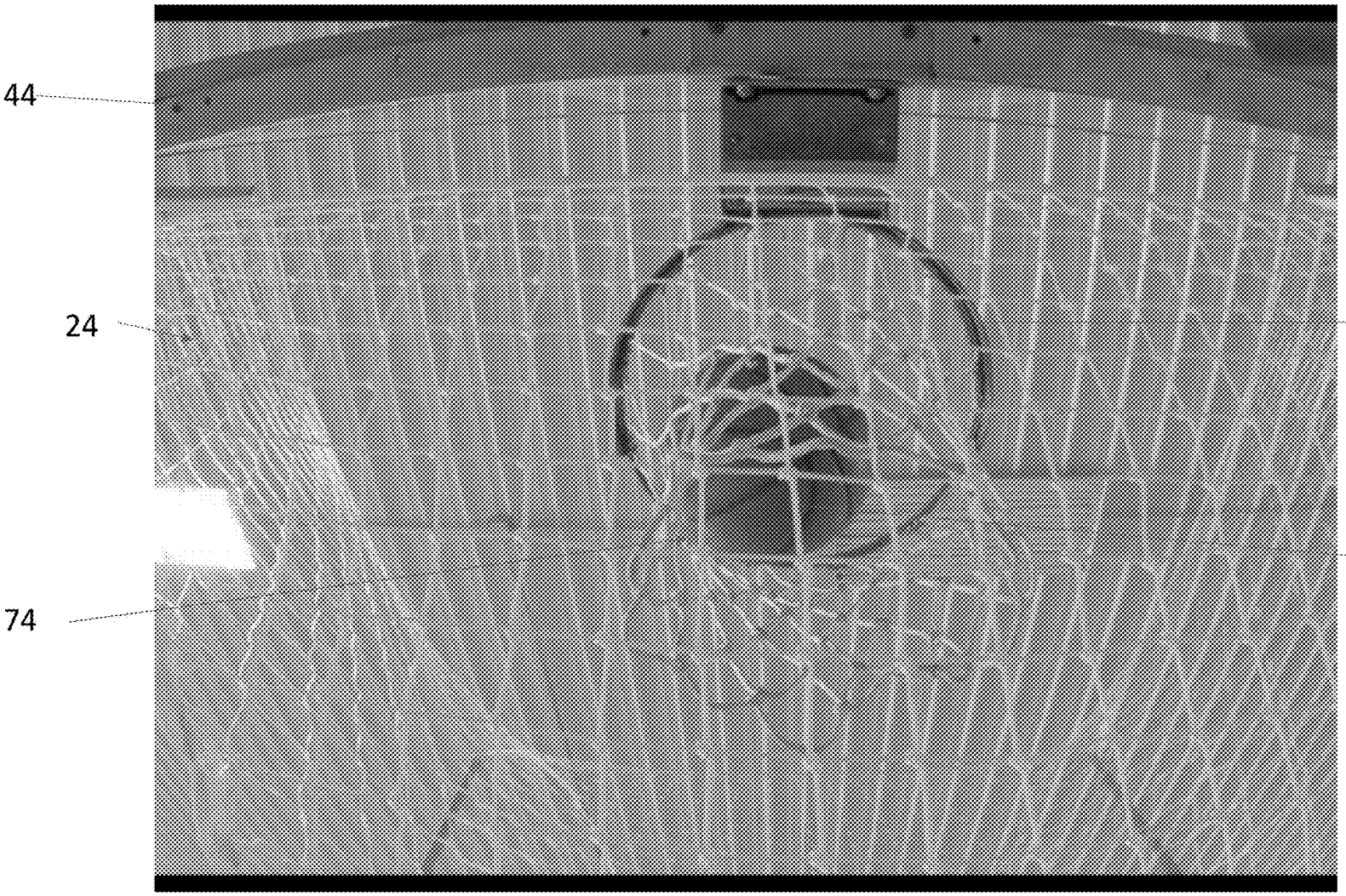
FIG. 5A is an exemplary image of a basketball passing through the hoop as seen by the camera(s) of the basketball launching device.
Figure 5B:
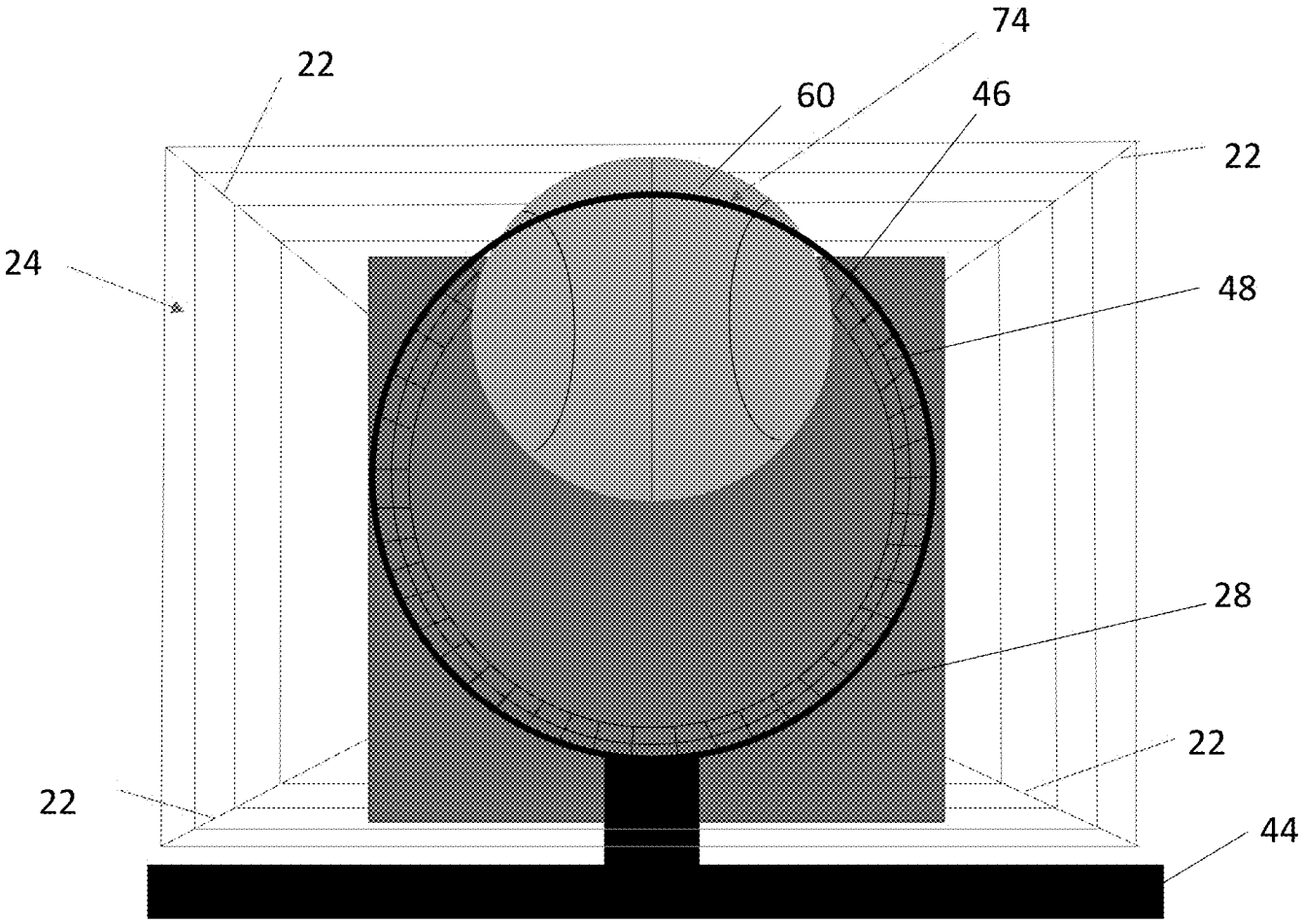
FIG. 5B is another exemplary image of a basketball passing through the hoop as seen by the camera(s) of the basketball launching device.

FIG. 5A is an exemplary image of a basketball 60 passing through the rim 46 as seen by the camera(s) 26—i.e., a made shot. The illustrated view is of an underside of the rim 46. The illustrated view is provided by way of non-limiting example. FIG. 5B is another exemplary image of a basketball 60 passing through the rim 46 as seen by the camera(s) 26—i.e., a made shot. The illustrated view is of an upper side of the rim 46. The illustrated view is provided by way of non-limiting example.

The size, shape, and/or location of elements in FIG. 5A-5B is merely exemplary and not intended to be limiting. For example, the exact size, shape, number, type, existence, and/or placement of the launcher 26, basketball 60, rim 46, backboard 44, support poles 22, net 24 combinations thereof, or the like may vary. As another example, without limitation, the exact image shown need not necessarily be captured to indicate a made shot. As yet another example, without limitation, the exact angle of the camera(s) 26 to provide the image may vary, which may vary field of view of the image(s) captured. Where multiple cameras 26 are utilized, multiple different types of images above or below the rim 46, such as viewing an upper side and/or underside of the rim 46 may be captured.

In exemplary embodiments, without limitation, the camera(s) 26 may be configured to capture images of basketballs passing through the rim 46 of the basketball goal. The camera(s) 26 may be positioned and/or otherwise configured to capture the entire basketball rim 46. In exemplary embodiments, without limitation, the camera(s) 26 are positioned and/or otherwise configured to capture a field of view not extending far from the basketball rim 46. For example, without limitation, the field of view may normally exclude areas more than a distance from a footprint of the basketball launching machine 10 (e.g., 1 foot, 3 feet, 18 inches, etc.). FIGS. 5A-5B illustrate exemplary fields of view for the camera(s) 26, though the provided illustrations are merely exemplary and not intended to be limiting. Any size, shape, and/or angle of field of view may be utilized. A limited field of view may, for example without limitation, reduce interference and/or protect privacy of users.

Figure 6:
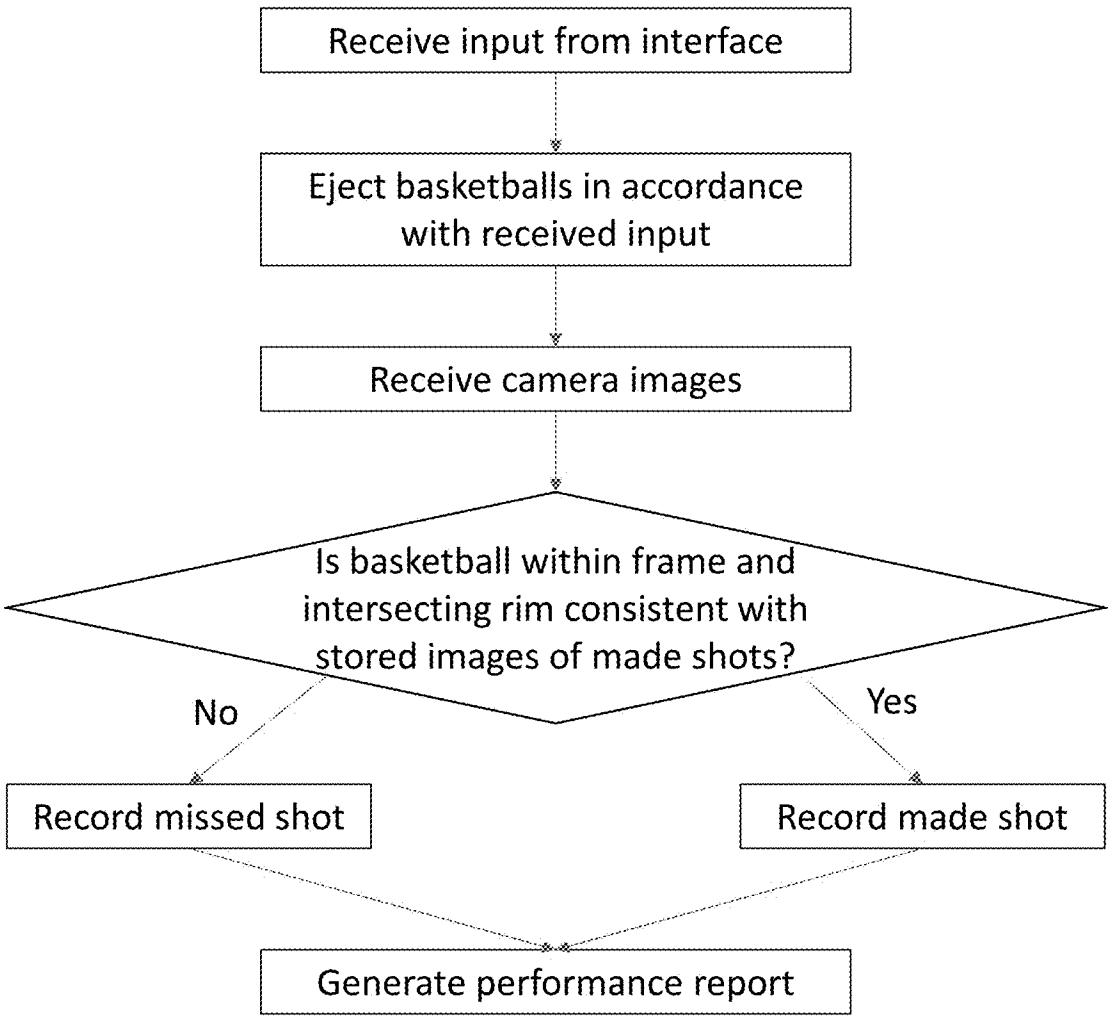
FIG. 6 is a flow chart with exemplary logic for operating the basketball launching device.

FIG. 6 is exemplary logic for use with the controller 68. The camera(s) 26 may be placed in electronic communication with the controller 68. The controller 68 may be configured to receive one or more images from the camera(s) 26. Such images may comprise a video and/or one or more still images. The images may be captured continuously, periodically, at a specific time interval, sporadically, some combination thereof, or the like. In exemplary embodiments, the camera(s) 26 may be configured to capture approximately 36-40 frames per second. The camera(s) 26 may be configured to capture images following the ejection of a basketball 60 by the launcher 28. For example, without limitation, the camera(s) 26 may be activated immediately, or a period of time after, the launcher 28 ejects a basketball.

The controller 68 may comprise software instructions, which when executed, cause the controller 68 to receive the images from the camera(s) 26 and utilize machine learning software to determine whether or not the received image comprises a basketball 60, a basketball 60 not passing through the rim 46, or a basketball 60 passing through the rim 46. The controller 68 may receive images from one or multiple of the camera(s) 26 that view an underside of the rim 46, an upper side of the rim 46, or both, from a same or different angles are received.

The controller 68 may comprise a number of images of a rim 46 without a basketball 60, a number of images of a rim 46 and a basketball 60 not passing through the rim 46, and a number of images of a basketball 60 passing through the rim 46. In other exemplary embodiments, such images may be provided at one or more remote databases. The images provided may be from one or multiple of the camera(s) 26 that view an underside of the rim 46, an upper side of the rim 46, or both, from a same or different angles. The controller 68 may be configured to derive, or may be programmed with, software instructions, which may comprise one or more algorithms, configured to distinguish between images with a basketball 60, images without a basketball 60, images with a basketball 60 intersecting a rim 46, images with the basketball 60 intersecting a front portion of the rim 46, images with a basketball 60 located within the rim 46, images with a basketball 60 not intersecting the rim 46, images of the basketball 60 progressing through the rim 46, some combination thereof, or the like. The controller 68 may be configured to make such determinations from images received from one or multiple of the camera(s) 26 that view an underside of the rim 46, an upper side of the rim 46, or both, from a same or different angles.

In exemplary embodiments, an attempted shot may be determined where images are received with no basketball 60 for a period of time following the ejection of a basketball 60 or images are received with a basketball 60 not passing completely through the rim 46. In exemplary embodiments, a made shot may be determined where images are received with a basketball 60 which passes completely through the rim 46. For example, without limitation, a basketball 60 may be determined to have completely passed through the rim 46 where the image of the basketball 60 is located within the rim 46 and/or is intersecting the front surface of the rim 46, as generally indicated at item 74. Alternatively, or in addition, the made shot may be confirmed by receipt of subsequent and/or further images showing a progression of the basketball 60 though the rim 46 in the manner and sequence consistent with a made shot. For example, without limitation, the machine learning software may be configured to search for images of a basketball 60 intersecting the rim 46, as generally indicated at item 74, in a fashion such that the basketball 60 progressively intersects more of the rim 46 for one or more frames before subsequently intersecting less of the rim 46 as is consistent with stored images of basketballs 60 passing through the rim 46.

Other type or kinds of analysis may be utilized to find other types of kinds of images. For example, the basketball 60 in the middle of the rim 74, the basketball 60 intersecting the net 48, the basketball 60 relative to the backboard 44, the support structure for the rim, the launcher 28 or components thereof, the support poles 22, the netting 24, court lines, combinations thereof, or the like.

The machine learning software may be provided with images from one or multiple of the camera(s) 26 that view an underside of the rim 46, an upper side of the rim 46, or both, from a same or different angles.

It may be determined with a high degree of confidence that a given basketball 60 passed through the rim 46, and thus a basketball goal was successfully made, where the received image matches, or is within a predetermined margin of error of, the stored images of basketballs 60 passing completely through the rim 46. Similarly, it may be determined with a high degree of confidence that a given basketball 60 did not pass through the rim 46, and thus a basketball goal was not made, where the received image matches, or is within a predetermined margin of error of, the stored images of basketballs 60 not in the frame and/or not passing completely through the rim 46. Such determinations made be made continuously or periodically as basketballs 60 are launched and shots are taken, or may be performed after a given practice session is completed.

Figure 7:
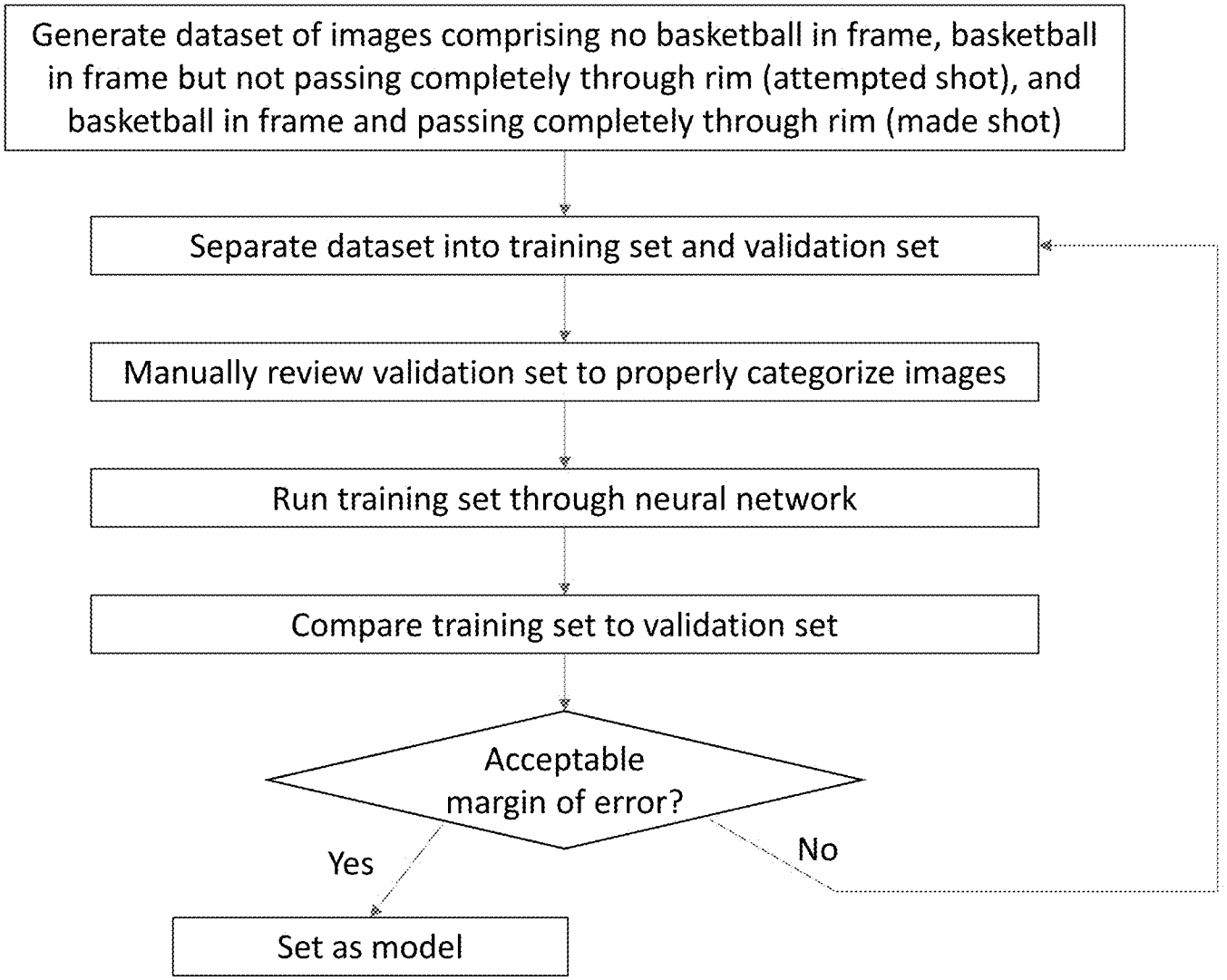
FIG. 7 is a flowchart of exemplary logic for creating a machine learning model for use with the basketball launching device.

FIG. 7 is a flowchart of exemplary logic for creating a machine learning model. In exemplary embodiments, a dataset comprising a number of images of a rim 46 without a basketball 60, a number of images of a rim 46 and basketballs 60 not passing completely through the rim 46, and a number of images of basketballs 60 passing completely through the rim 46 may be generated by taking a large number of such images. In exemplary embodiments, over 15,000 such images may be taken to form the dataset, though any number of images and any size dataset may be utilized. The images may be converted into a lossless format and may be resized as needed. A first subset of the images in the dataset may be separated for use as a training set. A second subset of the images in the dataset may be separated for use as a validation set. In exemplary embodiments, the first subset may comprise approximately 80% of the images and the second subset may comprise approximately 20% of the images. The first subset of images may be passed through a neural network to train the network to recognize each category of images. The second subset of images may be manually reviewed to properly categorize each image. The results of the first subset of images may be compared to the second subset, where the proper categorization is known, and the process may be repeated any number of times until the neural network is configured to categorize images with an acceptable degree of error to form a model. Once results within an acceptable threshold of accuracy is achieved, the neural network may be saved as a model. The model may then be utilized during actual practice sessions. The training may be performed off site and the model may be transferred to the controller 68. In other exemplary embodiments, the training may be performed at the controller 68.

Figure 8:
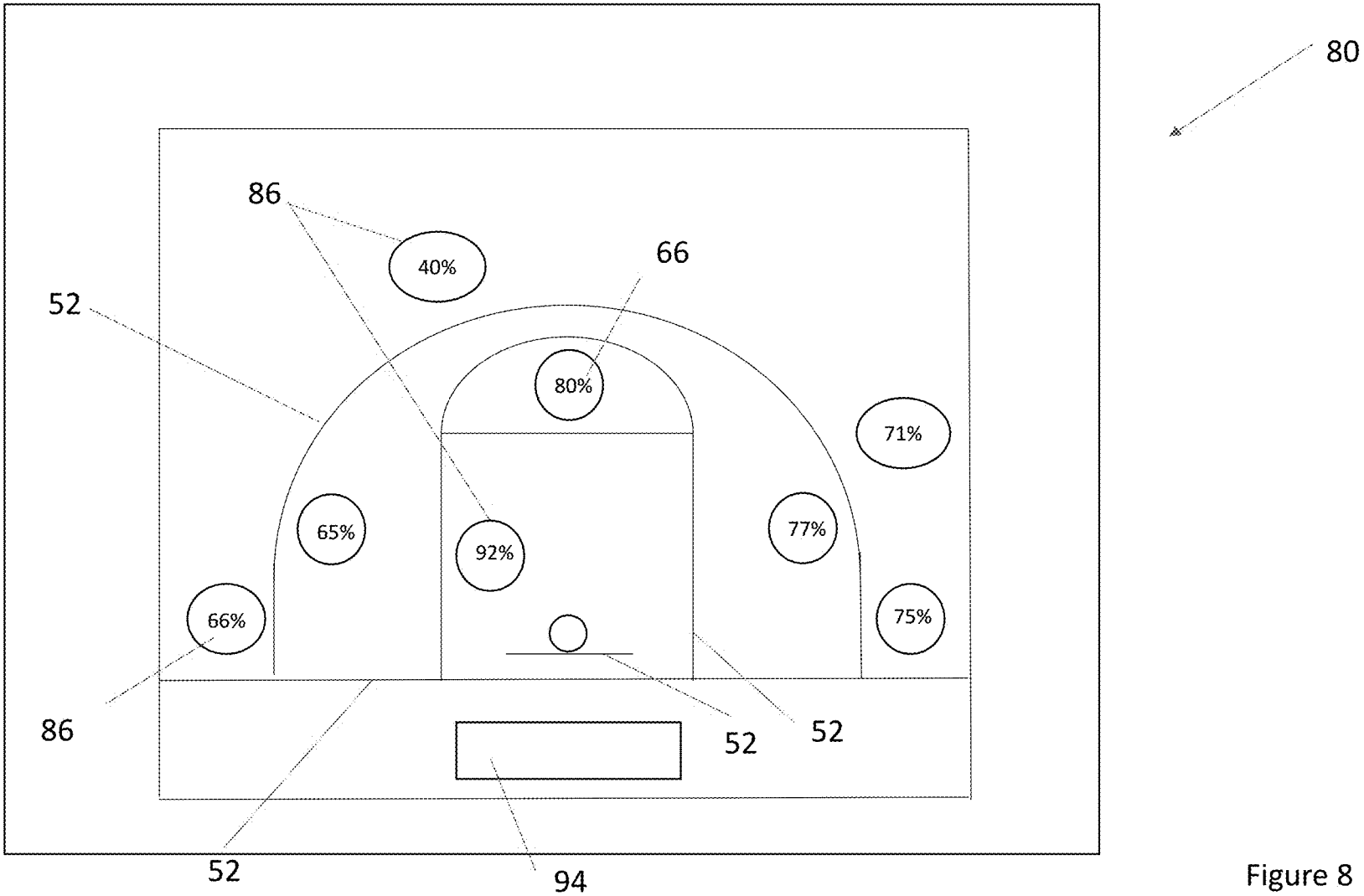
FIG. 8 is a front view of an exemplary performance report.

FIG. 8 illustrates the interface 50 with an exemplary performance report 80 for a given practice session. The report 80 may comprise the same or similar visual depiction 52 of the playing area 30, though such is not required. The visual depiction 52 may be the same or different from the visual depiction 52 provided at other displays, such as but not limited to at the interface 50.

The performance report 80 may comprise shooting feedback 86 located at, and corresponding to, substantially each of the selectable areas 62 forming the practice arrangement. The feedback 86 may by visually depicted with indicia of the same size and shape as the selectable areas 62, though such is not required. For example, without limitation, the feedback 86 may be provided without such indicia, or with different types, color, size, shape, or the like characteristics compared to the selectable areas 62. The feedback 86 may comprise a number of made shots, a number of missed shots, a percentage of made shots, a percentage of missed shots, a grade, a pass/fail indication, combinations thereof, or the like. The feedback 86 may be provided in the same or similar form, such as but not limited to, shape, font, color, size, some combination thereof, or the like, as the selectable areas 62. For example, without limitation, the selectable areas 62 and the feedback 86 may comprise circles. In this way, the user may be able to quickly ascertain their strong and weak shooting positions. An overall number and/or percentage of made and/or missed shots, or other information, may be displayed at a second area 94, though such is not required. In exemplary embodiments, such all number and/or percentage of made and/or missed shots, or other information, may, alternatively or additionally, be displayed at a separate display on the basketball launching device 10 or elsewhere.

The performance report 80 may be displayed at the interface 50. The performance report 80 may be generated at the controller 68, the interface 50, the personal electronic device 70, some combination thereof, or the like.

In other exemplary embodiments, the interface 50, and/or various displays thereof, may be provided on the personal electronic device 70 in addition to, or alternatively to, at the basketball launching machine 10. It is notable that the user of the interface 50 may be provided to the basketball player 72 or may be some other individual such as, but not limited to, a friend, parent, coach, assistant, or the like.

Figure 9:
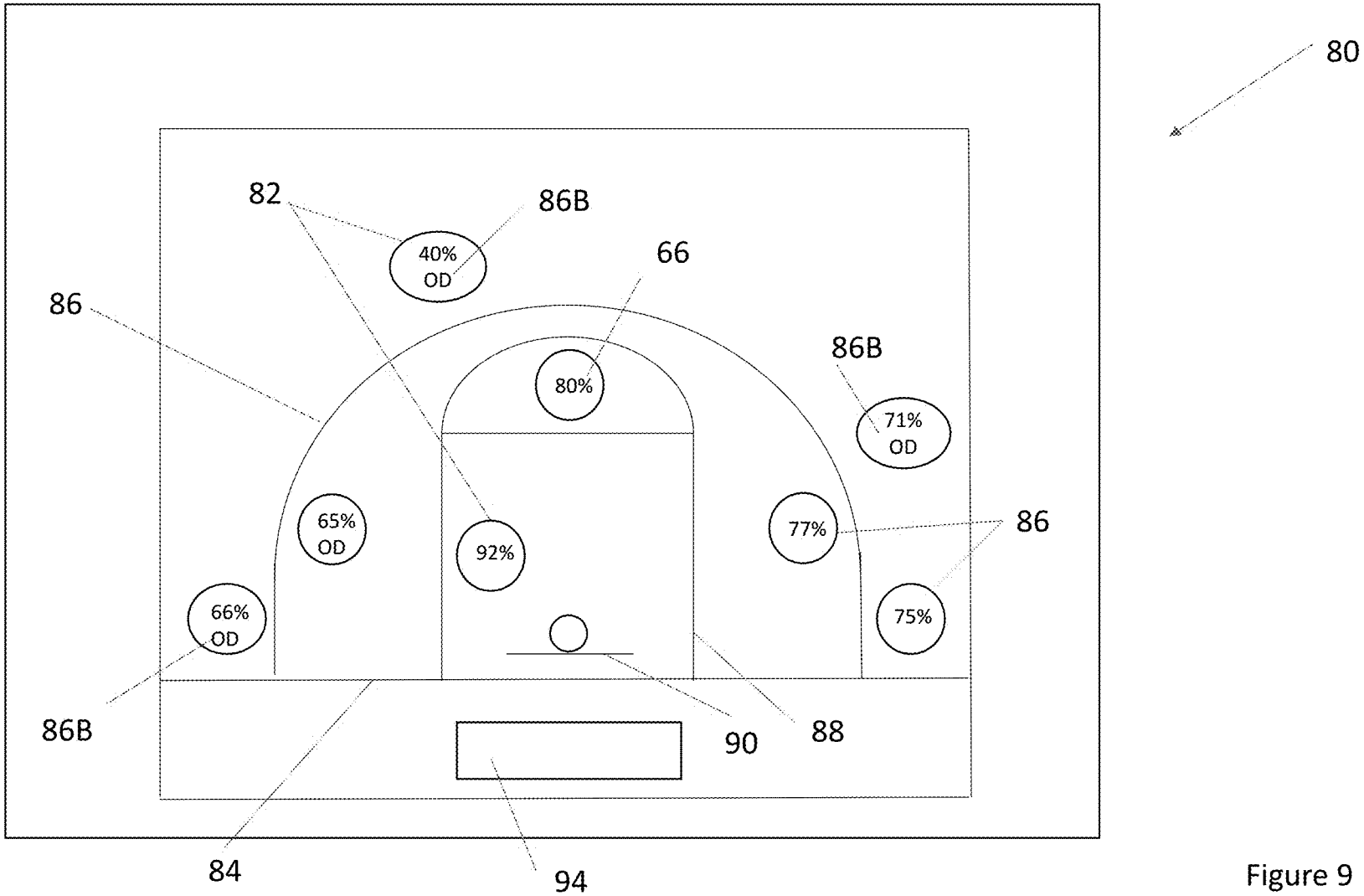
FIG. 9 is a front view of another exemplary performance report with off of the dribble shot tracking.

FIG. 9 illustrates another exemplary embodiment of the performance report 80. The performance report 80 may be configured to track and separately display, or otherwise indicate, off of the dribble shooting. Such information may be reflective of user selections made at the off of the dribble display 71 in exemplary embodiments. For example, without limitation, data may be received from the interface 50, such as but not limited to, from user selections made or provided at the off of the dribble display 71, indicating user selection or one or more travel paths 92, action markers 91, combinations thereof, or the like. Shots made or missed, as detected by the camera(s) 26, detectors, combinations thereof, or the like, may be separately recorded and displayed for shooting attempts associated with such off of the dribble shooting attempts and/or specific types of shots selected. Such association may be made by way of comparing a timing of launches from the launcher 28 and the timing of detected made and/or missed basketball shots. In exemplary embodiments, without limitation, a missed shot may be determined where a certain amount of time passes since said launch from the launcher 28 with no such detection of a made shot.

In exemplary embodiments, a qualifier 86B may be provided with at least certain ones of the feedback 86 to indicate association of the particular feedback 86 with off of the dribble shooting attempts. Such qualifiers 86B may comprise "OD" for "off of the dribble", or other indication, symbol, or the like of the travel path 92, the action markers 91, or other information about the off of the dribble nature of the shooting attempts provided to, or selected by, the user at the interface 50 for associated pass receipt and/or shooting locations. Alternatively, or additionally, different qualifiers 86B may be provided in association with an abbreviated or narrative description indicating the type of action item 91, travel path 92, and/or other type and/or kind of off of the dribble related action associated with the shooting statistics, each of which may be separately tracked, categorized, and displayed in exemplary embodiments based on user selections made at the interface 50 and data received from the detectors.

Figure 10:
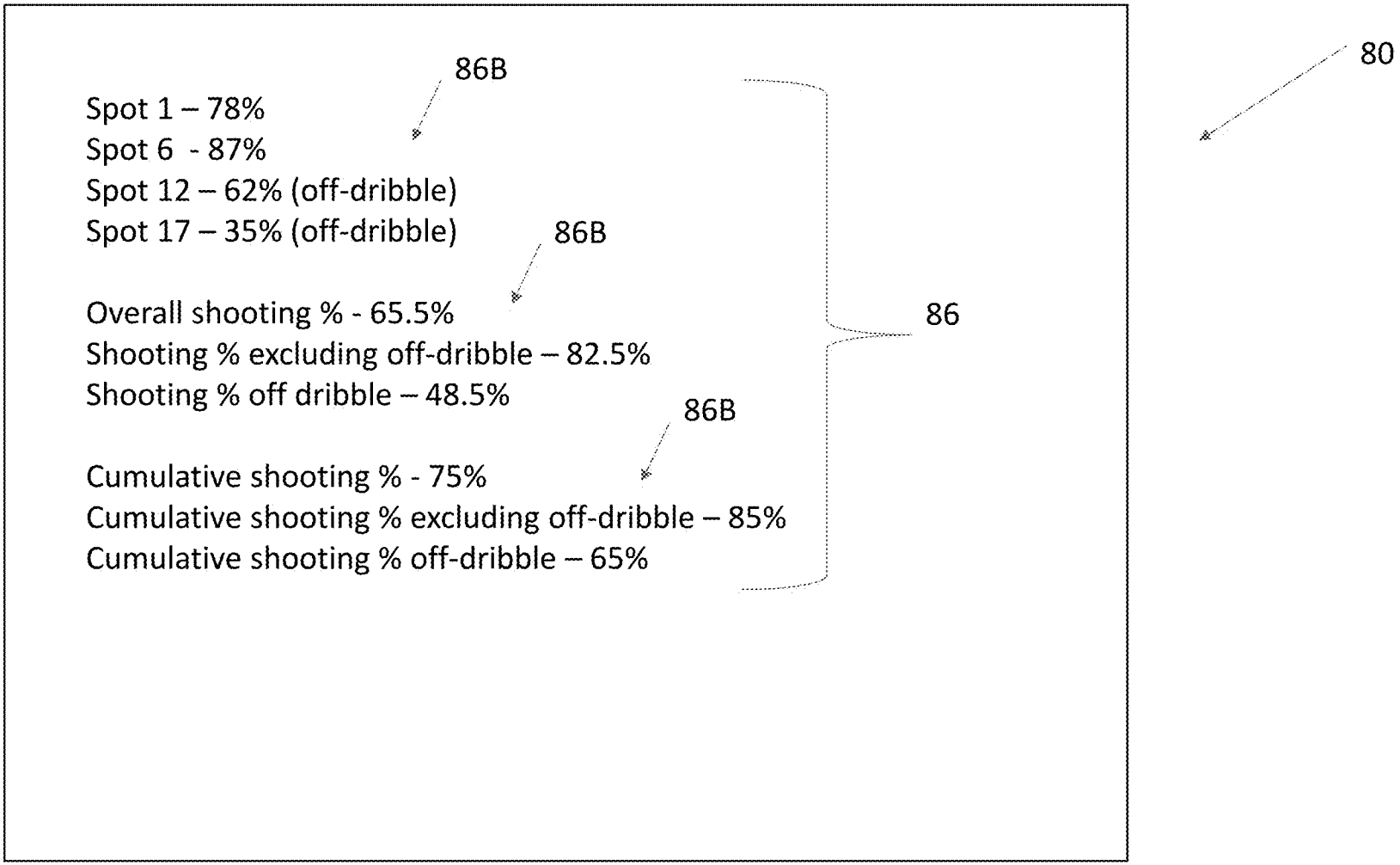
FIG. 10 is front view of another exemplary performance report with off of the dribble shot tracking.

FIG. 10 illustrates another exemplary embodiment of the performance report 80. The performance report 80 may comprise a listing of feedback 86, at least some of which may comprise the qualifiers 86B. Such feedback 86 may be provided for individual pass receipt and/or shooting locations selected or provided at the interface 50 and/or overall categorizations of such statistics for one or more shooting sessions, across a team or other group, combinations thereof, or the like. Such feedback 86 may be provided together or separately, such as in listings, a scrolling manner, combinations thereof, or the like.

Figure 11:
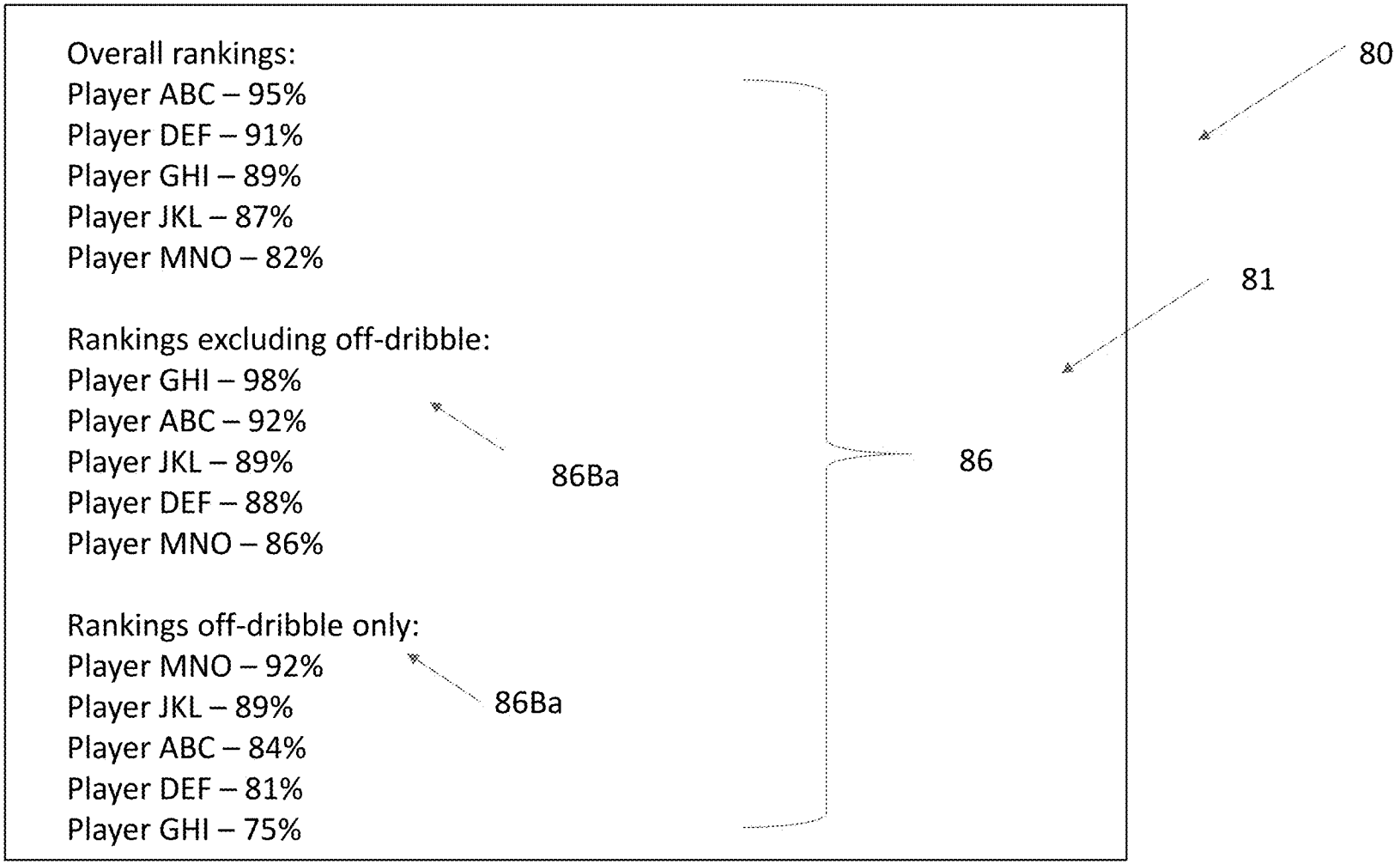
FIG. 11 is front view of another exemplary performance report with off of the dribble shot tracking.

FIG. 11 illustrates another exemplary embodiment of the performance report 80 in the form of a ranking display 81. Players may be ranked as a team, group, members of a gym, club, or the like, or according to user preferences. Qualifiers 86B may be provided adjacent to, or otherwise in association with, certain of the feedback 86. Such feedback 86 may be provided for individual pass receipt and/or shooting locations selected or provided at the interface 50 and/or overall categorizations of such statistics for one or more shooting sessions, combinations thereof, or the like. Such feedback 86 may be provided together or separately, such as in listings, a scrolling manner, combinations thereof, or the like.

Figure 12:
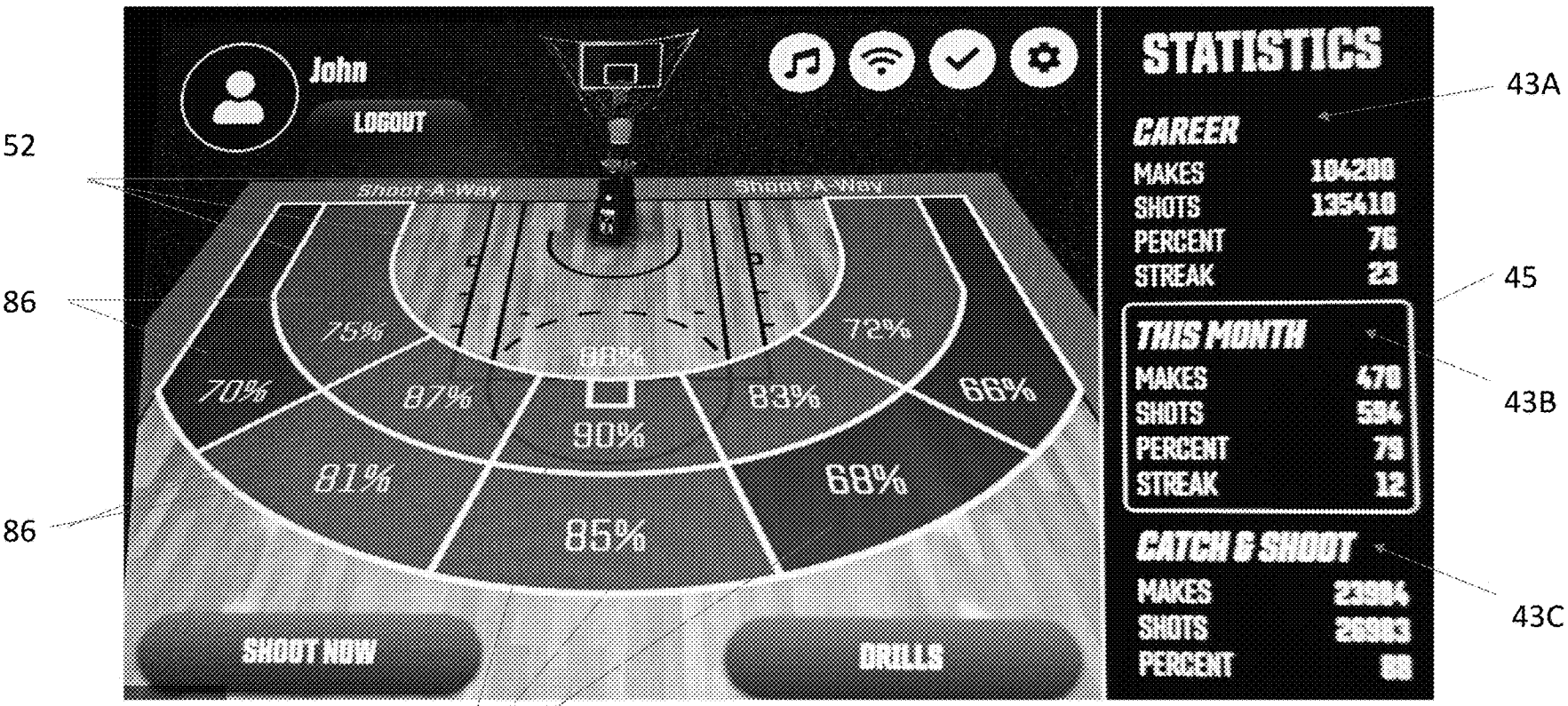
FIG. 12 is a front view of another exemplary performance report with off of the dribble shot tracking.
Figure 13:
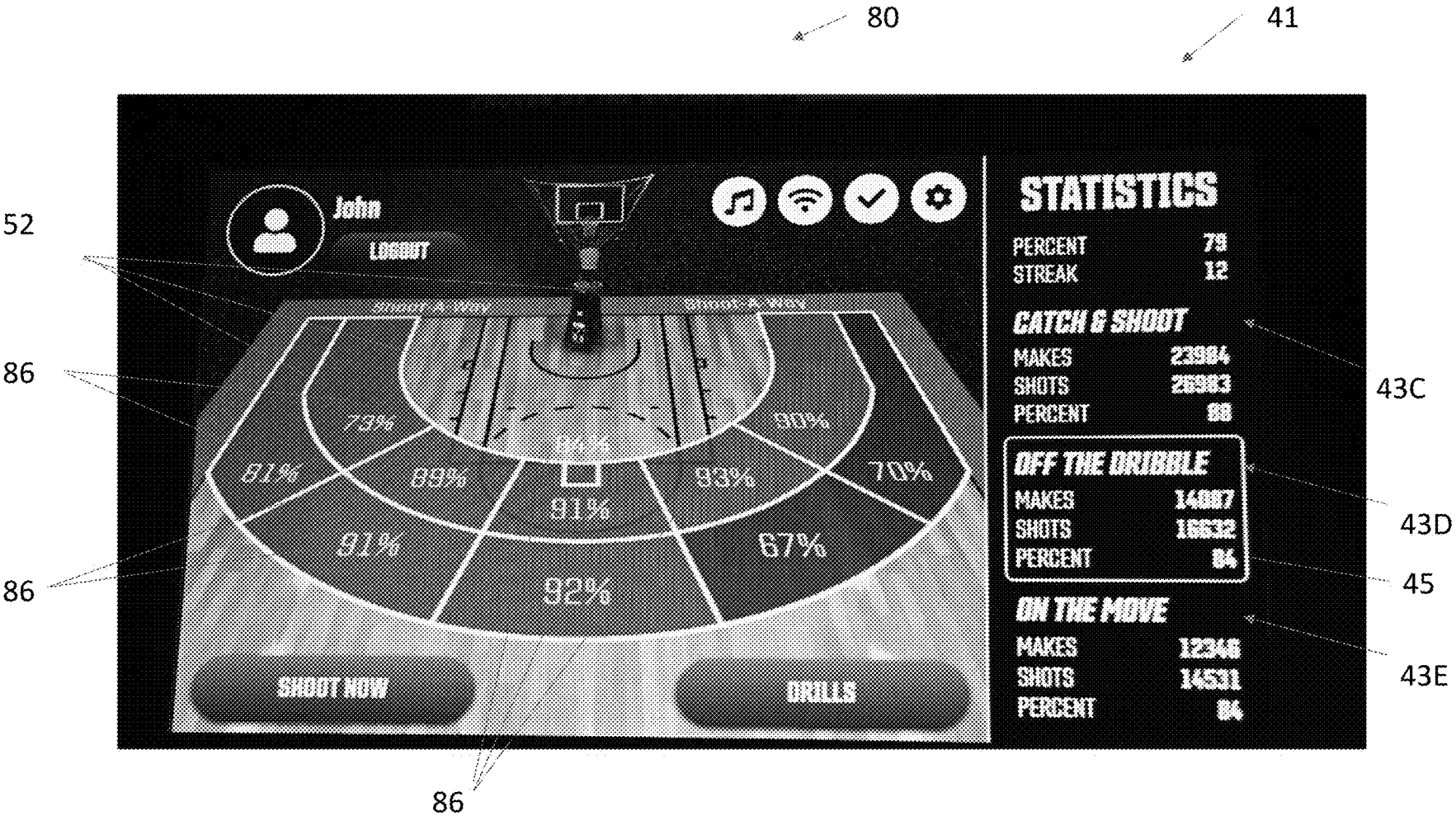
FIG. 13 is a front view of another exemplary performance report with off of the dribble shot tracking.

FIG. 12 and FIG. 13 illustrate other exemplary embodiments of the performance report 80. The feedback 86 may comprise percentages of made shots for each of the selectable locations 62. The feedback 86 may be color coded to indicate feedback above or below a predetermined threshold. For example, in the example provided in FIGS. 12 and 13, feedback above 70% is indicated with a red area while feedback at or below 70% is indicated in blue. Some of all of the feedback 86 may not be color coded.

A feedback category selectable area 41 may be provided as part of, or separate from, the performance report 80. A number of categories 43 for feedback 86 to be displayed at the feedback category selectable area 41. The various categories 43 may be selected by a user, such as shown by selection indicator 45, and the corresponding category 43 of feedback 86 may be generated for display at the performance report 80. The selection indicator 45 may be, for example without limitation, a box around a selected category 43.

Such categories 43 may include, for example without limitation, career 43A (e.g., lifetime cumulative statistics for a given user), monthly 43B, catch and shoot 43C (e.g., not off the dribble), off of the dribble 43D, on the move 43E (e.g., where travel paths 92 are associated with shooting), combinations thereof, or the like. Some or all of the titles for such categories 43, such as but not limited to off of the dribble 43D and/or on the move 43E, may serve as qualifiers 86B in exemplary embodiments. In exemplary embodiments, the various categories 43 may be accessed by swiping, such as where the performance report 80 is provided on a touch screen, though other techniques may be utilized. In exemplary embodiments, the various categories 43 may be selected by touching, such as where the performance report 80 is provided on a touch screen, though other techniques may be utilized. In exemplary embodiments, off of the dribble shooting may be shooting attempts made following dribbling drills (e.g., catch the basketball, dribble it an amount, distance, time, combinations thereof, or the like, and then make a shooting attempt). On the move shooting may be shooting attempts made while the player is moving immediately before catching the basketball, and do not necessarily involve dribbling (e.g., running off a simulated or actual screen, pick and roll drill, cutting drill, combinations thereof, or the like). The on the move shooting may include off the dribble shooting, or vice-versa, though such is not required. In exemplary embodiments, on the move shooting attempts may be those associated with travel lines 92 and off the dribble shooting attempts may be those associated with action markers 91, though the reverse or other combinations may be utilized.

Cumulative feedback 86 for a given category 43 may be provided in association with each category 43. In exemplary embodiments, each category 43 may comprise at least a title, a cumulative number of made shots for the category, a cumulative number of shots taken for the category 43, and a percentage of made shots for the category 43. However, any number, type, kind, organization, and the like of such feedback 86 and such categories 43 may be utilized.

Figure 14:
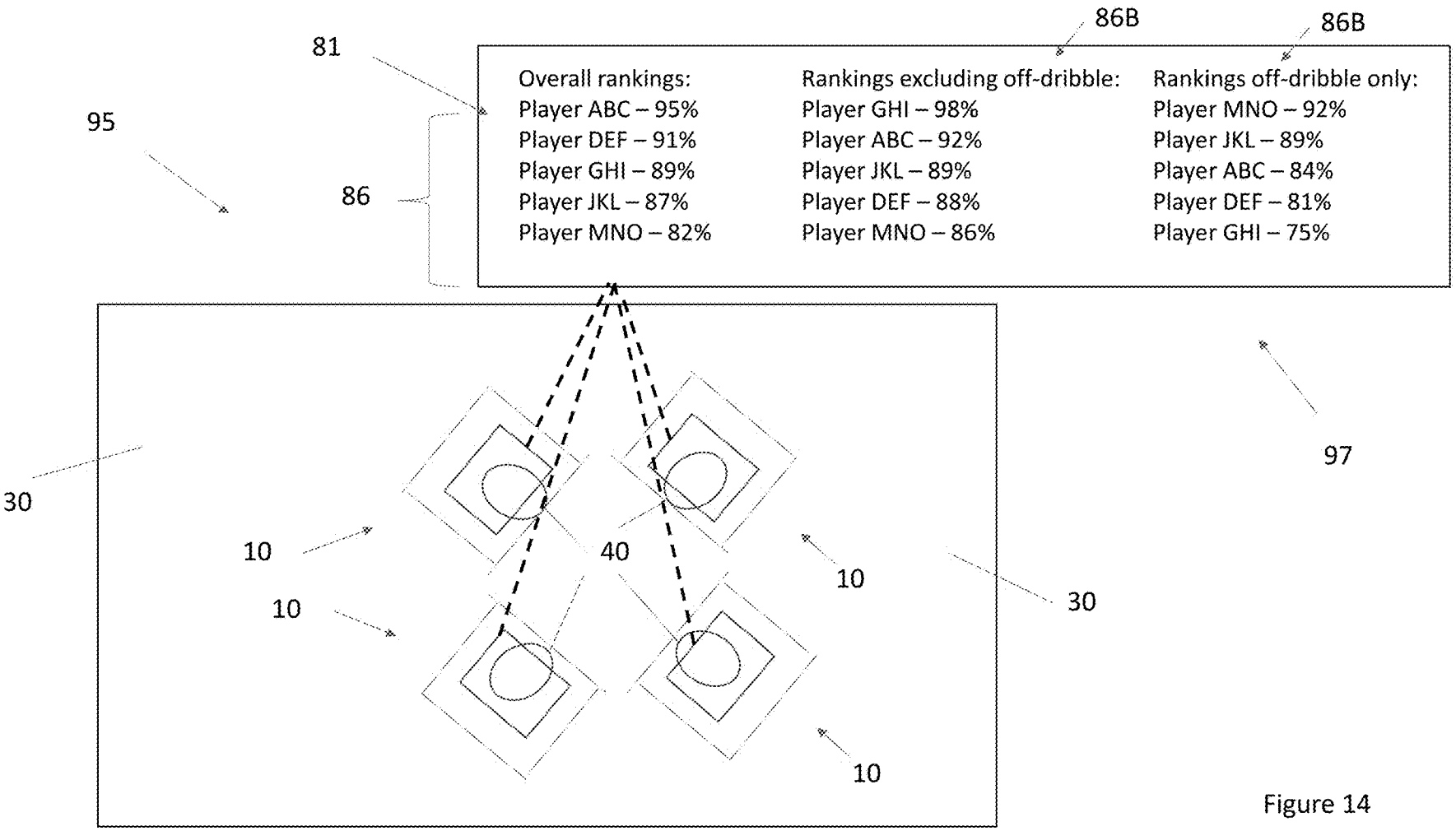
FIG. 14 is a perspective view of an exemplary facility with multiple basketball launching devices and an exemplary scoreboard.
Figure 15:
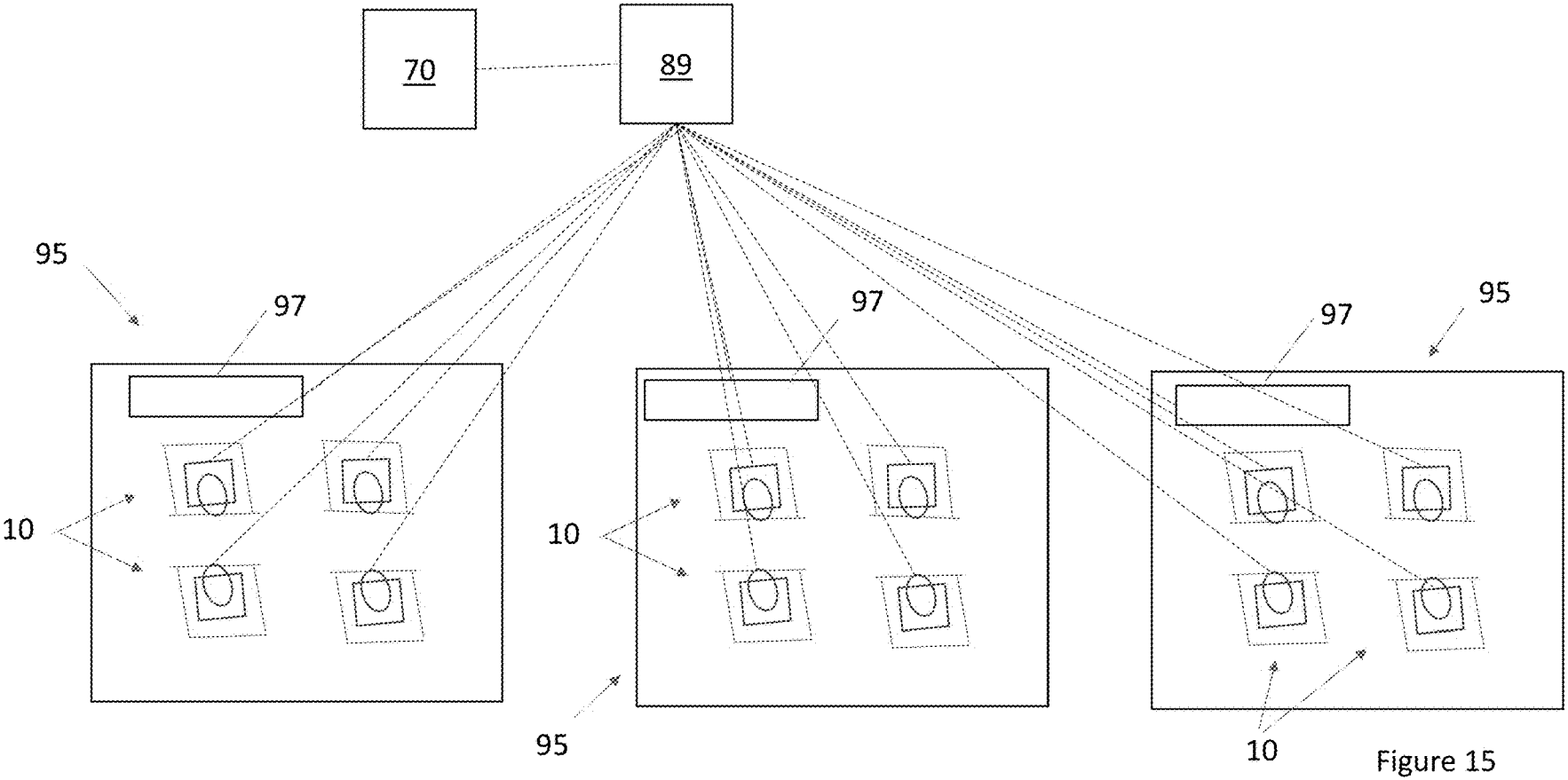
FIG. 15 is a plan view of an exemplary multi-facility competition system in accordance with the present invention.
Figure 16:
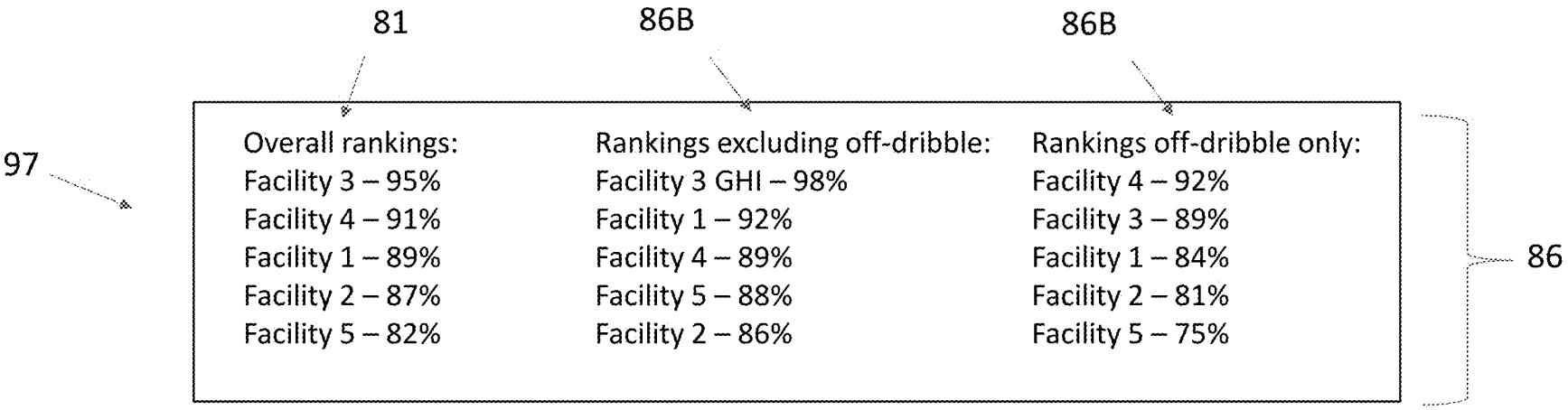
FIG. 16 is a detailed front view of an exemplary scoreboard for use with the system of FIG. 15.

FIG. 14 though FIG. 16 illustrate exemplary competition facilitating systems. A facility 95 configured to hold one or more basketball launching machines 10 may be provided. The facility 95 may be a gym, recreation center, school facility, retail location, or any other type of kind space and/or building. The facility 95 may have a ceiling height sufficient to accommodate players shooting basketballs towards the one or more basketball launching machines 10. The facility 95 may have one or more playing surfaces, such as a wooden basketball playing floor with or without regulation or non-regulation playing line markings, configured to facilitate basketball play. One or more basketball launching machines 10 may be provided about the same or different playing areas 30. Each of the basketball launching machines 10 may be associated with a basketball goal 40, though such is not required. Netting, walls, or other dividers may be provided between each of the basketball launching machines 10.

Multiple players may practice at the one or more basketball launching machines 10 at the same or different times. Data may be transmitted from one or more of the basketball launching machines 10, associated personal electronic devices 70, combinations thereof, or the like, wired or wirelessly, to one or more scoreboards 97. The scoreboard(s) 97 may be configured to generate and/or display the performance report 80 in any embodiment, combinations thereof, or the like shown and/or described herein. The scoreboard(s) 97 may be positioned within the facility 95, such as but not limited to, mounted to one or more walls or from a ceiling thereof, in view of some or all of the basketball launching machines 10. In exemplary embodiments, the scoreboard(s) 97 are configured to display a ranking 81 of shooting statistics or other feedback 86 for various players in a group, team, or the like. In exemplary embodiments, at least some of the statistics 86 may comprise, or consist of, statistics associated with off of the dribble shooting attempts and qualifiers 86B may be provided indicating the same. The qualifiers 86B may be configured to indicate off the dribble shooting attempts and/or non-off the dribble shooting attempts.

The controller 68 may be configured to associate certain data received from the detector, such as the camera(s) 26, with off dribble shooting attempts based on user selections made at the off the dribble selection area 69. For example, without limitation, made/missed data from the detector may be indicated as being associated with off the dribble shooting attempts where said data is associated with pass receipt locations associated with selectable areas 62 or icons forming part of a current practice arrangement and associated with user selections made at the off dribble selection area 69.

A single interface 50 and/or controller 68 may be used to control each of the basketball launching machines 10. Alternatively, or additionally, a separate interface 50 and/or controller 68 may be provided for each of the basketball launching machines 10. In this way, a common practice routine may be provided to each of the basketball launching machines 10 for a competitive challenge by the single interface 50, or commonly programmed at each machine 10. Alternatively, separate practice routines may be provided for each of the basketball launching machines 10, such as by the single interface 50 or separate interfaces 50.

In exemplary embodiments, the scoreboards 97 may be configured to display feedback 86, such as shooting statistics, from all such basketball launching machines 10 in a given facility 95. The scoreboard 97 may periodically or continuously display feedback 86 for all users of the basketball launching machines 10 within the facility 95, or a subset of such users, such as but not limited to, current users of such machines 10. This may facilitate competition between users of machines 10 of a given facility 95. In other exemplary embodiments, the scoreboards 97 may be configured to display feedback 86 from basketball launching machines 10 in multiple facilities 95. In such embodiments, the statistics displayed may be for all users of all such machines 10 in all such facilities 95, or a subset of such users. This may facilitate competition intra-facility 95 competitions, such as but not limited to, intra-region, intra-conference, intra-state, national, or worldwide competitions. As another example, without limitation, the scoreboard 97 may be configured to display cumulative feedback 86 for all users of all machines 10 at a given facility 95 against all user of all machines 10 at another facility 95, or subsets of such users. This may facilitate intra-facility 95 competitions. In still other embodiments, the scoreboards 97 may be configured to display feedback 86 for select groups of users and/or select machines 10 of select facilities 95. This may facilitate group competitions, such as but not limited to, friends, families, teams, or the like.

The feedback 86 from multiple machines 10 and/or facilities 95 may be gathered at one or more centralized databases 89, though such is not required. Such databases 89 may, alternatively or additionally, be in electronic communication with remote devices 70 such as laptops, smartphones, tablets, servers, combinations thereof, or the like. The centralized databases 89, where utilized, may be in electronic communication with each other and/or the scoreboards 97 of any number of facilities 95. User's may be able to specify relationships with facilities 95, groups (e.g., friends, families, teams, combinations thereof, or the like), regions, conferences, states, nations, combinations thereof, or the like to facilitate such scoring, display, and competition. Such information may be recorded by way of the user interfaces 50, at the databases 89, at remote devices 70, combinations thereof, or the like. A single, central database 89 may be provided for all facilities 95, for example. As another example, a database 89 may be provided for each facility 95 and each of said databases may be in communication with one another 89.

A separate scoreboard 97 may be provided in each facility 95, though such is not required. The individual machines 10, the databases 89, and/or the remote devices 70 may be in electronic communication with one or more of the scoreboards 97 and be configured to command said scoreboards 97 to display the feedback 86, including but not limited to, rankings 81 and qualifiers 86B in association with some or all of the displayed feedback 86. The feedback 86 may be displayed in any form or format, including but not limited to, as a ranking 81 and/or the same or similar to some or all of the performance report 80.

The interface 50 and various displays thereof as shown and provided herein, including but not limited to the location selection display 51, the off of the dribble display 71, and/or the performance report 80 (in any exemplary embodiment shown and/or described herein, combinations thereof, or the like) may be provided at the basketball launching machine 10, the remote personal electronic device 70, the scoreboard 97, combinations thereof, or the like.

The various selection or selectable areas shown and/or described herein, such as but not limited to selection devices 64, areas 67, off of the dribble selection area 69, and/or second area 94, may be separate from, or integrated with, the various displays such as, but not limited to, the visual depiction 52, the off of the dribble display 71, the location selection display 51, the reports 80, the shooting feedback 86, selectable areas 86, markers 66, combinations thereof, and the like such that such items are provided on a common interface 50, display, touch screen, panel, or the like or on separate displays, touch screens, panels, interfaces 50, or the like.

Mounting or connections shown and/or described herein may be made directly or indirectly (e.g., by intervening members, brackets, combinations thereof, or the like).

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

Certain operations described herein may be performed by one or more electronic devices. Each electronic device may comprise one or more processors, electronic storage devices, executable software instructions, and the like configured to perform the operations described herein. The electronic devices may be general purpose computers or specialized computing device. The electronic devices may comprise personal computers, smartphone, tablets, databases, servers, or the like. The electronic connections and transmissions described herein may be accomplished by wired or wireless means. The computerized hardware, software, components, systems, steps, methods, and/or processes described herein may serve to improve the speed of the computerized hardware, software, systems, steps, methods, and/or processes described herein.

What is claimed is:

1. A system for automatically detecting made and missed basketball shots using machine vision, said system comprising:

a structural subassembly;

a launcher connected to said structural subassembly and configured to pass basketballs to locations about a basketball playing area having a basketball goal;

one or more cameras connected to said structural subassembly and configured to, at least in part by position and orientation of said camera, capture images of an underside or an upper side of a rim of said basketball goal;

one or more controllers comprising software instructions, which when executed, configure said one or more controllers to:

program said launcher to pass at least one of said basketballs to various ones of said locations forming part of a basketball practice arrangement;

receive images from said one or more cameras for said basketball practice arrangement;

associate each of said received images with one of said passes from said launcher for said basketball practice arrangement; and process each of said received images using a machine vision model to determine which of said received images indicate a made shot.

2. The system of claim 1 wherein:

said one or more controllers comprise additional software instructions, which when executed, configured said one or more controllers to generate a performance report comprising an indicator of made shots performance for each of said locations of said basketball practice arrangement in accordance with said processed images.

3. The system of claim 2 wherein:

said performance report comprises a rendering of basketball court lines and the indicators of made shots performance are provided at locations at the rendering corresponding to said locations of said basketball practice arrangement.

4. The system of claim 3 wherein:

each of said indicators comprise a number or percentage.

5. The system of claim 1 further comprising:

an interface configured to receive user input selecting the various ones of the locations to form part of said basketball practice arrangement, wherein said one or more controllers comprise additional software instructions, which when executed, configured said one or more controllers to receive data indicating said user input from said interface, and program said launcher in accordance with said user input.

6. The system of claim 5 wherein:

said interface comprises a touch screen; and said interface is configured to display a representation of a portion of a regulation basketball playing area and at least selected ones of said locations of said basketball practice arrangement.

7. The system of claim 6 wherein:

said interface is in wireless electronic communication with said one or more controllers.

8. The system of claim 1 wherein:

said one or more controllers are in wireless electronic communication with said launcher.

9. The system of claim 1 wherein:

at least one of said one or more cameras is oriented to capture images of the underside of the rim.

10. The system of claim 9 wherein:

said structural subassembly comprises a frame; and each of said one of said one or more cameras is mounted to an upper portion of said frame and oriented vertically.

11. The system of claim 1 wherein:

at least one of said one or more cameras is oriented to capture images of the upper side of the rim.

12. The system of claim 11 wherein:

said structural subassembly comprises support poles; and each of said one or more cameras is mounted to one of said support poles and oriented at a downward angle.

13. The system of claim 1 further comprising:

multiple support poles forming part of said structural subassembly; and a netting extending between the support poles, at least an upper portion of which is configured to extend above the rim and is configured to capture at least some of the basketballs thrown towards the rim and funnel the captured ones of the basketballs to the launcher, wherein at least one of said one or more cameras is mounted to one of said support poles and oriented to capture images of the upper side of the rim.

14. The system of claim 1 wherein:

said structural subassembly comprise a frame;

said structural subassembly comprise a support pole;

at least one of said one or more cameras is mounted to said frame and oriented to capture images of the underside of the rim; and at least one other one of said one or more cameras is mounted to said support pole and oriented to capture images of the upper side of the rim.

15. The system of claim 1 wherein:

the machine vision model is configured to determine that a respective one of said received images indicates a made shot where the machine vision model determines that the respective one of the received images comprises a basketball intersecting a portion of the rim.

16. The system of claim 1 wherein:

the machine vision model is configured to determine that a respective subset of successive ones of said received images indicates a made shot where the machine vision model determines that the respective subset of successive ones of said received images comprise a progression of said basketball through said rim.

17. The system of claim 1 wherein:

the machine vision model is configured to determine that a respective one of said received images indicates a missed shot where the machine vision model determines that the respective one of the received images does not comprise the basketball.

18. The system of claim 1 further comprising:

additional software instructions stored at the one or more electronic storage devices, which when executed, configure the one or more processors to:

receive a dataset of images comprising a first subset of images without basketballs, a second subset of images with basketball passing through the rim, and a third subset of images with basketballs not passing through the rim;

receive data from a manual review and categorization of the dataset of images indicating that each of the images in the second subset of images is a made shot and each of the images in the first subset of images and the second subset of images is a missed shot;

process the dataset of images through a neural network to categorize each of the images in the dataset of images as indicating a made shot or a missed shot; and if the categorization from the processed dataset is accurate in comparison with the data from the manual review and categorization above a target threshold, set the neural network as the machine vision model.

19. A system for automatically detecting made and missed basketball shots using machine vision, said system comprising:

a structural subassembly comprising support poles;

netting connected to said support poles;

a launcher connected to said structural subassembly and configured to pass basketballs to locations about a basketball playing area having a basketball goal;

multiple cameras, a first one of which is mounted to said frame in an upward facing orientation to capture images of an underside a rim of said basketball goal, a second one of which is mounted to one of said support poles in a downward facing orientation to capture images of an upper side of said rim;

an interface configured to receive user input selecting various one or ones of the locations at the basketball playing area for the launcher to pass said basketballs to as part of a basketball practice arrangement;

one or more controllers comprising software instructions, which when executed, configure said one or more controllers to:

receive data from said interface indicating said user input;

program said launcher to pass at least one of said basketballs to each of said various one or ones of the locations forming part of said basketball practice arrangement in accordance with said user input;

receive images from said cameras for said basketball practice arrangement;

associate each of said received images with one of said passes from said launcher forming part of said basketball practice arrangement;

process each of said received images using a machine vision model to determine which of said received images indicate a made shot; and update performance data for said basketball practice arrangement in accordance with said processed images.

20. A system for automatically detecting made and missed basketball shots using machine vision, said system comprising:

a structural subassembly;

a launcher connected to said structural subassembly and configured to pass basketballs to locations about a basketball playing area having a basketball goal;

one or more cameras, each connected to said structural subassembly and oriented in one of: an upward facing direction to capture images of an underside of a rim of said basketball goal, and a downward facing direction to capture images of an upper side of the rim of said basketball goal;

an interface configured to receive user input selecting various one or ones of the locations at the basketball playing area for the launcher to pass said basketballs to as part of a basketball practice arrangement;

one or more controllers comprising software instructions, which when executed, configure said one or more controllers to:

receive data from said interface indicating said user input;

program said launcher to pass at least one of said basketballs to each of said various one or ones of the locations forming part of said basketball practice arrangement in accordance with said user input;

receive images from said cameras for said basketball practice arrangement;

associate each of said received images with one of said passes from said launcher forming part of said basketball practice arrangement;

process each of said received images using a machine vision model to determine which of said received images indicate a made shot; and update one or more performance scores for said basketball practice arrangement in accordance with said processed images.

* * * * *